US009028677B2

(12) United States Patent
McFarlane et al.

(10) Patent No.: US 9,028,677 B2
(45) Date of Patent: May 12, 2015

(54) DEMULSIFYING OF HYDROCARBON FEEDS

(75) Inventors: Richard McFarlane, Edmonton (CA); Michael Peter Singleton, Calgary (CA)

(73) Assignee: Suncor Energy Inc., Calgary, Alberta (CA)

( * ) Notice: Subject to any disclaimer, the term of this patent is extended or adjusted under 35 U.S.C. 154(b) by 132 days.

(21) Appl. No.: 13/140,634

(22) PCT Filed: Dec. 17, 2009

(86) PCT No.: PCT/CA2009/001859

§ 371 (c)(1),
(2), (4) Date: Oct. 19, 2011

(87) PCT Pub. No.: WO2010/069075

PCT Pub. Date: Jun. 24, 2010

(65) Prior Publication Data

US 2012/0029259 A1 Feb. 2, 2012

(51) Int. Cl.
*C10G 33/04* (2006.01)

(52) U.S. Cl.
CPC ..... *C10G 33/04* (2013.01)

(58) Field of Classification Search
None
See application file for complete search history.

(56) References Cited

U.S. PATENT DOCUMENTS

| | | | |
|---|---|---|---|
| 1,472,384 | A | 10/1923 | Brown |
| 2,269,134 | A | 1/1942 | Tarnoski et al. |
| 4,406,774 | A | 9/1983 | Cummings et al. |
| 4,684,457 | A | 8/1987 | McKechnie et al. |
| 4,737,265 | A | 4/1988 | Merchant, Jr. et al. |
| 7,867,382 | B2 | 1/2011 | Droughton |
| 2009/0134068 | A1 | 5/2009 | Falkiner et al. |

FOREIGN PATENT DOCUMENTS

| | | | |
|---|---|---|---|
| CA | 2657844 | C | 11/2013 |
| WO | 2012/015666 | A2 | 2/2012 |

OTHER PUBLICATIONS

International Search Report and Written Opinion, International Application No. PCT/CA2009/001859 dated Mar. 23, 2010.
Douglas M. Considine, P.E., editor-in-chief, Energy Technology Handbook, CRC Press, 1977, pp. 3-12 to 3-17.
Gary et al., Petroleum Refining, McGraw-Hill, 2001, p. 345.
Canadian Office Action dated May 7, 2014, for Canadian Patent Application No. 2,647,964.

(Continued)

*Primary Examiner* — Tam M Nguyen
(74) *Attorney, Agent, or Firm* — Knobbe, Martens, Olson & Bear, LLP.

(57) ABSTRACT

In various aspects, the invention provides for processing a hydrocarbon feed having hydrocarbon and emulsified aqueous components demulsifying into hydrocarbon and aqueous phases over an initial demulsification time, with an active agent to form a treated feed. The active agent has an active agent solubility in the hydrocarbon component and in the aqueous component, the aqueous component has an aqueous component solubility in the hydrocarbon component. The active agent solubility in the hydrocarbon component is greater than the aqueous component solubility in the hydrocarbon component. The active agent solubility in the aqueous component is greater than the active agent solubility in the hydrocarbon component. The active agent solubility in the aqueous component is greater than the active agent solubility in the hydrocarbon component. A treated demulsified hydrocarbon phase separates from the active agent and the aqueous component in a modified demulsification time that is shorter than the initial demulsification time.

93 Claims, 14 Drawing Sheets

(56) References Cited

OTHER PUBLICATIONS

Baker-Hughes, Planning Ahead for Effective Canadian Crude Processing, 2010, pp. 1-10.
Office Action dated Oct. 2, 2013 issued by the Canadian Patent Office concerning CA Application 2,647,964.
Office Action dated Feb. 5, 2014 issued by the Canadian Patent Office concerning CA Application 2,647,964.
Ovchinnikov, et al. "Oil sands-derived feed processing" published by digitalrefining.com and dated Jul. 2013.
Office Action dated Apr. 10, 2014 issued by the State Intellectual Property Office of the People's Republic of China (together with an English language translation) concerning CN Application 200980151324.2.
Office Action dated Jan. 31, 2014 issued by the Australian Patent Office concerning Patent Application No. 2013205049.
Office Action dated Jan. 31, 2014 issued by the Australian Patent Office concerning Patent Application No. 2013205077.

DEMULSIFYING OF HYDROCARBON FEEDS

CROSS REFERENCE TO RELATED APPLICATIONS

This application is the U.S. National Phase of International Application No. PCT/CA2009/001859, filed Dec. 17, 2009, designating the U.S. and published as WO 2010/069075 on Jun. 24, 2010 which claims the benefit of Canadian Patent Application No. 2,647,964 filed Dec. 19, 2008.

FIELD OF THE INVENTION

The invention relates generally to processing of hydrocarbon feeds derived from in situ and ex situ tar sand and heavy oil operations, off shore oil production operations, conventional oil, secondary and tertiary recovery, and natural gas operations. More particularly the invention relates to processing such hydrocarbon feeds to effect emulsion breaking, desalting, dewatering or a combination thereof to obtain feeds having water and salt contents reduced to levels suitable for downstream processing operations.

BACKGROUND OF THE INVENTION

In tar sands operations, bitumen is generally found in reservoirs comprising high concentrations of saline water. During various stages of processing the bitumen in situ and ex situ, the bitumen and water are prone to forming emulsions comprising water droplets finely dispersed throughout the bitumen matrix. Such emulsions are stabilized by the presence of various surfactant species and fine solids dispersed in the bitumen matrix, including in the aqueous phase, which prevent or interfere with coalescence of the water droplets during processing of bitumen feeds.

The concentration of water and various salt species in the bitumen matrix must be reduced to an acceptable level prior to downstream processing of the bitumen due to equipment operational requirements and the detrimental effects of the salts on the equipment such as corrosion, catalyst poisoning, negative impact on processing efficiencies and cost. Certain hydrocarbon feeds from heavy oil and offshore oil operations may also present similar emulsion and salt content challenges depending on the source of the hydrocarbon feed, and on added water in the hydrocarbon feed which must be subsequently removed for downstream operations.

Various methods have been used in the art to achieve a reduction in the water and salt contents in hydrocarbon feeds. A reduction in both water and salt content in bitumen, for example, may be achieved by removing the water comprising salts, which may include addition of fresh water to the hydrocarbon feed with mixing in order to promote coalescence of the fresh water droplets with saline water droplets, and thereby sediment and remove the saline water. However, in such processes, water-in-oil emulsions generally result from the mixing, and require further processing to promote separation of the hydrocarbon phase from residual water. Examples of conventional separation processes include gravity separation with and without the addition of demulsifiers to break water-in-oil emulsions, centrifugation, and electrostatic field treatment technologies. These processes are, however, often unsuccessful at effectively removing substantially all of the water and salts due to stable micro-emulsion formation.

Therefore, there is a need in the industry for processing hydrocarbon feeds to effect emulsion breaking, desalting, dewatering or a combination thereof to obtain feeds having water and salt contents reduced to levels suitable for downstream processing operations including upgrading.

SUMMARY OF THE INVENTION

In accordance with one aspect of the invention, there is provided a method of processing a hydrocarbon feed (the hydrocarbon feed having a hydrocarbon component and an aqueous component emulsified in the hydrocarbon component, wherein the hydrocarbon feed demulsifies into a hydrocarbon phase and an aqueous phase over an initial demulsification time period) by contacting the hydrocarbon feed with an active agent to form a treated feed, wherein the active agent has an active agent solubility in the hydrocarbon component, the aqueous component has an aqueous component solubility in the hydrocarbon component, the active agent solubility in the hydrocarbon component is greater than the aqueous component solubility in the hydrocarbon component, the active agent has an active agent solubility in the aqueous component, the active agent solubility in the aqueous component is greater than the active agent solubility in the hydrocarbon component, the active agent solubility in the aqueous component is greater than the aqueous component solubility in the hydrocarbon component; and the active agent dissolves in the aqueous component to decrease the dielectric constant of the aqueous component, and allowing a treated demulsified hydrocarbon phase to separate from the active agent and the aqueous component in the treated feed in a modified demulsification time period, wherein the modified demulsification time period is shorter than the initial demulsification time period. In various embodiments, the active agent is an alcohol or pure alcohol such as methanol, or an alcohol/water mixture such as a methanol/water mixture. In various embodiments, the alcohol comprises 1 to 6 carbon atoms in a linear chain.

In another aspect, there is provided an apparatus for processing a hydrocarbon feed, the apparatus comprising a source of the hydrocarbon feed, the hydrocarbon feed having a hydrocarbon component and an aqueous component emulsified in the hydrocarbon component, the aqueous component having an aqueous component solubility in the hydrocarbon component, wherein the hydrocarbon feed demulsifies into a hydrocarbon phase and an aqueous phase over an initial demulsification time period. The apparatus further comprising a source of an active agent, the active agent having an active agent solubility in the hydrocarbon component and an active agent solubility in the aqueous component, the active agent solubility in the hydrocarbon component being greater than the aqueous component solubility in the hydrocarbon component, the active agent solubility in the aqueous component being greater than the active agent solubility in the hydrocarbon component, the active agent solubility in the aqueous component being greater than the aqueous component solubility in the hydrocarbon component, the active agent dissolving in the aqueous component to decrease the dielectric constant of the aqueous component. The apparatus further comprising contacting means for contacting the active agent with the hydrocarbon feed to form a treated feed, wherein a treated demulsified hydrocarbon phase is allowed to separate from the active agent and the aqueous component in the treated feed in a modified demulsification time period, wherein the modified demulsification time period is shorter than the initial demulsification time period.

The apparatus may further comprise active agent modulating means for modulating the properties of the active agent, the active agent modulating means in communication with the source of the active agent.

The apparatus may further comprise recovering means for recovering the active agent, the aqueous component or a combination thereof from the treated feed comprising the treated demulsified hydrocarbon phase.

The apparatus may further comprise recycling means for recycling the recovered active agent to the source of the active agent.

In another aspect, there is provided a method for processing a substantially dehydrated hydrocarbon feed comprising a salt (i.e., salty dehydrated feed) using the active agent to effect desalting, emulsion breaking, dewatering or a combination thereof to obtain a hydrocarbon feed depleted in the salt, water or a combination of salt and water to a level suitable for downstream processing. In another aspect, there is provided an apparatus for processing a substantially dehydrated hydrocarbon feed.

In another aspect there is provided a method for selecting and modulating the properties of various active agents suitable for use in the processing of the hydrocarbon feed to effect emulsion breaking, dewatering, desalting, or a combination thereof wherein:

i. the active agent has an active agent solubility in the hydrocarbon component;
ii. the active agent solubility in the hydrocarbon component is greater than the aqueous component solubility in the hydrocarbon component;
iii. the active agent has an active agent solubility in the aqueous component;
iv. the active agent solubility in the aqueous component is greater than the active agent solubility in the hydrocarbon component;
v. the active agent solubility in the aqueous component is greater than the aqueous component solubility in the hydrocarbon component; and,
vi. the active agent dissolves in the aqueous component to decrease the dielectric constant of the aqueous component;

Compositions of suitable active agents are also disclosed. In various aspects, the active agent when contacting the hydrocarbon feed may be a liquid, gas or a combination thereof. In various selected embodiments, the active agent may be a protic active agent comprising an alcohol, a mixture of more than one alcohol (i.e., alcohol/alcohol mixture), or an alcohol/water mixture, the alcohol/alcohol mixture or alcohol/water mixture having co-alcohol or water content tailored to the chemical properties of the particular hydrocarbon feed. In another aspect there is provided an apparatus for modulating the properties of various active agents suitable for use in the processing of the hydrocarbon feed to effect emulsion breaking, dewatering, desalting, or a combination thereof.

In various aspects, optimal exposure of the active agent to the input hydrocarbon feed may be achieved by modulating chemical properties of the active agent, using various mixing or contacting methods, using equipment having physical and chemical properties that enhance effective contacting (e.g., structured or unstructured packing, sieve trays, rotating disks) and subsequent separation of a used active agent component and a treated demulsified hydrocarbon phase (e.g., using various coatings on the equipment used at various stages of the process), modulating physical and chemical properties of the input hydrocarbon feed in various pretreatment stages prior to contacting with the active agent, and modulating operating conditions of the system. In various other aspects, a method and apparatus provide for the recovery and recycling of the active agent.

In another aspect, there is provided a method and an apparatus for modulating the chemical and physical properties of the hydrocarbon feed (e.g., relative polarity, density, or interfacial tension of the aqueous and hydrocarbon components in the feed) by using the active agent which has suitable solubility in the aqueous and hydrocarbon components of the hydrocarbon feed to effect emulsion breaking, dewatering, desalting or a combination thereof under the process conditions.

In a further aspect, there is provided a method and an apparatus for modulating a composition of a substantially dehydrated hydrocarbon feed comprising a salt dispersed as fine solid through various pre-treatments (e.g., wetting the feed) to render it suitable for treatment using the active agent which has suitable solubility in the aqueous and hydrocarbon components of the hydrocarbon feed.

There are also provided various input hydrocarbon feed compositions that may be treated using the method and apparatus of the present invention including hydrocarbon feeds derived from tar sand and heavy oil operations, off shore oil production, conventional oil, secondary and tertiary recovery, and natural gas operations both in situ and ex situ. For example, hydrocarbon feeds such as crude oil and heavy oil having an API gravity of less than about 22.3 or bitumen having an API gravity of less than about 10 are examples of suitable input feeds for use in various embodiments. Hydrocarbon feeds having API gravity of greater than about 22.3 and which comprise water-in-hydrocarbon emulsions as a result of production or subsequent processing are also examples of suitable input feeds for use in other embodiments. Salty dehydrated hydrocarbon feeds initially comprising oil-wet salt particles dispersed in the matrix of the feed and substantially no water, which have been subsequently pre-wetted to form a water-in-hydrocarbon emulsion prior to using the method and apparatus of the present invention are also suitable feeds. The method and apparatus in accordance with various aspects of the present invention are also useful for application to synthetic or natural hydrocarbon feeds from biofuel operations or any other operations that produce a hydrocarbon feed comprising water-in-hydrocarbon emulsions, salts, salty dehydrated hydrocarbon components or a combination thereof.

The foregoing and other aspects of the invention will become more apparent from the following description of specific embodiments thereof and the accompanying drawings which illustrate, by way of example only, the principles of the invention.

BRIEF DESCRIPTION OF THE DRAWINGS

In accompanying drawings which illustrate embodiments of the invention.

DETAILED DESCRIPTION

Figure 1:
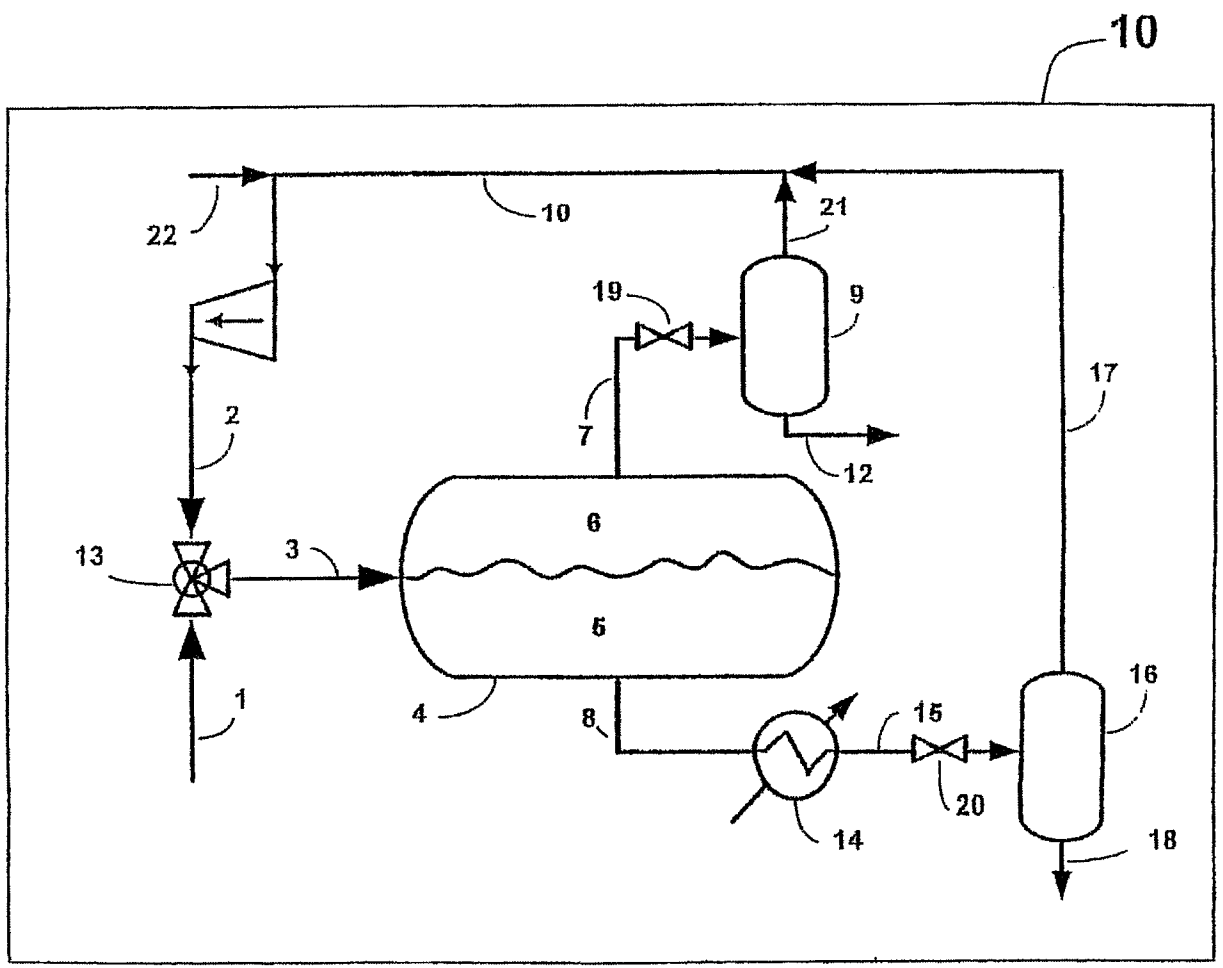
FIG. 1 illustrates a schematic diagram of system 10 according to a first embodiment of the invention.

Reference will now be made in detail to implementations and embodiments of various aspects and variations to the invention, examples of which are illustrated in the accompanying drawings.

The terms "a hydrocarbon feed" or "oil" in various embodiments of the invention refer to any natural or synthetic liquid, semi-liquid or solid hydrocarbon material derived from oil sands processing in situ and ex situ including hydrocarbon material having an API value of less than about 10°, heavy oil production (e.g., about 10 to about 22.3° API), medium oil production (e.g., about 22.3 to about 31.1° API), light oil production (e.g., > about 31.1° API), off shore oil production, natural gas operations, conventional oil, secondary and tertiary recovery, and any other industry (e.g., biofuel industry) in which it is necessary to process the hydrocarbon feed to effect emulsion breaking, dewatering, desalting, or a combination of thereof. In various embodiments, the hydrocarbon feed may comprise various levels of chemical contaminants such as, for example, various levels of water, hydrogen sulfide, organosulfur and inorganic sulfur compounds, various salts and salt-forming species, organometallic and inorganic species, surfactants, solids, or processing additives, the removal of which is desirable for downstream applications.

In various embodiments, the hydrocarbon feed may be pretreated prior to the treatment of the hydrocarbon feed. Pretreatment may include physical and chemical treatments such as, for example, initial bulk water removal (e.g., for wet feeds) or water addition to form a water-in-hydrocarbon emulsion (e.g., for salty dehydrated feeds) using conventional technologies, initial separation or fractionation, and thermal treatment or processing (e.g., flashing of water or other lighter hydrocarbon fraction and thermal cracking).

In various embodiments, hydrocarbon feeds suitable for processing may have initial viscosities ranging from less than about 1 cP to about 1,000,000 cP or greater. Viscosities at various processing conditions are determined by the rate of mass transfer required to achieve water removal, desalting, emulsion breaking or a combination thereof at a given feed rate.

In this specification, the term "aqueous component" (also referred to as emulsified water content) refers to the amount of water emulsified in the hydrocarbon feed at a given instance initially prior to the treatment of the feed or at any stage of the process during treatment of the hydrocarbon feed. In various embodiments, the content of the aqueous component in the hydrocarbon feed may vary depending on the source, chemical composition of the hydrocarbon feed (e.g., hydrocarbon feeds comprising various surfactant species or fine solids may retain more water in the hydrocarbon matrix), pretreatment of the hydrocarbon feed or a combination thereof. In selected embodiments, the content of the aqueous component in the hydrocarbon feed for treatment using the method and apparatus of the invention may be in the range of about 0 to about 80 wt. %, or about 0 to about 50%, or any range between about 0 and about 80 wt. %. In particular embodiments, the aqueous component in the hydrocarbon feed for treatment may be in the range of about 0 to about 0.1 wt. %, or about 0.1 to about 0.25 wt. %, or about 0.25 to about 0.5 wt. %, or about 0.5 to about 1.0 wt. % water, or about 1.0 to about 5 wt. %, or about 5 to about 10 wt. %, or about 10 to about 30 wt. %, or about 30 to about 80 wt. %. In various embodiments, the aqueous component of the hydrocarbon feed may further comprise various chemical species (e.g., dissolved or dispersed hydrocarbon fractions, salts or salt forming species or a combination thereof).

In this specification, the terms "salt" and "salts" are used interchangeably and unless the context dictates otherwise, indicate one or more organic or inorganic salts (e.g., normal, acidic or basic, simple, double, or complex) or salt-forming species soluble in water, in the active agent or both, or which may be modulated by the active agent to become soluble in water, in the active agent or both, including salts that are typically found in bitumen, bitumen-derived hydrocarbon fractions or conventional oils and heavy oils. Predominant inorganic salts may be one or more of chlorides (e.g. monovalent and divalent), sulphates and bicarbonates. The predominant counterion for such inorganic salts may be sodium, although lesser amounts of magnesium, potassium and calcium may be present. An example of an organic salt or a salt forming species that may be present could be a naphthenate such as that formed from neutralization of naphthenic acid. Such salts or salt-forming species may be dispersed or dissolved in the aqueous component associated with the hydrocarbon feed (e.g., interstitial water and bulk water), may be dispersed in the hydrocarbon matrix without the presence of water (e.g., oil-wet salts dispersed as fine solids), may occupy the hydrocarbon-aqueous component interface, or a combination thereof.

A hydrocarbon feed to be treated to effect emulsion breaking, dewatering, desalting or a combination thereof according to the present invention may comprise about 0 to about 0.1 parts per million (ppm), about 0.1 to about 2 ppm, about 2 to about 50 ppm, about 50 to about 100 ppm, about 100 to about 200 ppm, about 200 to about 300 ppm, about 300 to about 400 ppm, about 400 to about 500 ppm, about 500 to about 750 ppm, about 750 to about 900 ppm, or about 50,000 ppm or more of one or more salts or salt-forming species. For example, in particular embodiments comprising dilbit as the hydrocarbon feed, the dilbit may comprise as much as about 15,000 ppm of sodium chloride, about 350,000 ppm of calcium chloride, about 100,000 ppm of magnesium chloride, about 1,500 ppm of calcium carbonate, about 100 ppm of magnesium carbonate or a combination thereof. The salt content will vary depending on the source and chemical composition of the hydrocarbon feed, pretreatment or a combination thereof.

In this specification the term "emulsion" refers to an heterogeneous mixture of two substantially immiscible liquid or semi-liquid phases wherein one phase is dispersed as small droplets in the second phase and where the droplets of the first phase have a reduced tendency to coalesce or collide with each other such that the two phases do not spontaneously separate. In this specification, the aqueous component is emulsified in the hydrocarbon component of the hydrocarbon feed, and is referred to as an aqueous component-in-hydrocarbon emulsion, a water-in-hydrocarbon emulsion, a water-in-oil emulsion, and in selected embodiments as a salt water-in-hydrocarbon emulsion.

In various embodiments, the term "emulsion breaking" refers to separating the hydrocarbon feed (the hydrocarbon feed having a hydrocarbon component and an aqueous component emulsified in the hydrocarbon component, wherein the hydrocarbon feed demulsifies into a hydrocarbon phase and an aqueous phase over an initial demulsification time period) by contacting the hydrocarbon feed with an active agent.

In some embodiments, the hydrocarbon feed demulsifies into a hydrocarbon phase and an aqueous phase over an initial demulsification time period. In this context, demulsification of the hydrocarbon feed is necessarily a matter of degree, reflecting the extent to which demulsification proceeds to complete resolution of hydrocarbon and aqueous phases. As used herein, the term is used to mean that a distinct aqueous phase is resolved from the hydrocarbon feed, so that a proportion of the aqueous phase may remain emulsified, but the emulsion has been broken to the extent that is required to give rise to a distinct aqueous phase. In some embodiments, the initial demulsification time period may be at least days.

A treated demulsified hydrocarbon phase is allowed to separate from the active agent and the aqueous component in the treated feed in a modified demulsification time period, wherein the modified demulsification time period is shorter than the initial demulsification time period. The modified demulsification time period may be shorter than the initial demulsification time period by a factor of at least about 1.1 times. In various embodiments, the modified demulsification time period may be of the order of about 1 to about 30 minutes.

In this specification, the term "dilbit" refers to bitumen diluted with suitable hydrocarbon diluents such as naphtha, other lower density and viscosity liquid hydrocarbon-comprising mixtures such as diesel, kerosene or other oil fractions, or pure hydrocarbons such as propane, toluene and the like. Bitumen to diluent ratio may range from about 10:1 to about 1:1 or about 1:1 to about 1:10.

In this specification, the terms "active agent" and "active agent composition" are used interchangeably and refer to a chemical compound or a composition that, when contacted with the hydrocarbon feed, is able to effect, at selected processing parameters, emulsion breaking, dewatering (dehydration), desalting, or a combination thereof, wherein i. the active agent has an active agent solubility in the hydrocarbon component. In various embodiments, the active agent solubility in the hydrocarbon component may range from about 0.01 to about 1 wt. %, or about 1 to about 10 wt. %, or about 10 to about 50 wt. %;
ii. the aqueous component has an aqueous component solubility in the hydrocarbon component. The aqueous component solubility in the hydrocarbon component may range from about 0 to about 0.1 wt. %;
iii. the active agent solubility in the hydrocarbon component is greater than the aqueous component solubility in the hydrocarbon component;
iv. the active agent has an active agent solubility in the aqueous component. In various embodiments, the active agent solubility in the aqueous components may range from about 0.01 to about 1 wt. %, or about 1 to about 10 wt. %, or about 10 to about 50 wt. %, or about 50 to about 99.9 wt. %;
v. the active agent solubility in the aqueous component is greater than the active agent solubility in the hydrocarbon component;
vi. the active agent solubility in the aqueous component is greater than the aqueous component solubility in the hydrocarbon component; and
vii. the active agent dissolves in the aqueous component to decrease the dielectric constant of the aqueous component. In various embodiments, the decrease in the dielectric constant of the aqueous component may be in the range of about 1 to about 10, or about 10 to about 20, or about 20 to about 30, or about 30 to about 40, or about 40 to about 50, or about 50 to about 70;

Unlike demulsifiers which are soluble either in the aqueous component or in the hydrocarbon component of aqueous component-in-hydrocarbon emulsions or hydrocarbon-in-aqueous component emulsions, the active agent has varying degrees of solubility in both the aqueous component and the hydrocarbon component of the hydrocarbon feed. Furthermore, unlike demulsifiers, which are confined to the interface between the aqueous component and the hydrocarbon component in the emulsion, the active agent due to its solubility properties can penetrate or cross the interface in the emulsion to change the bulk properties of the emulsified aqueous component (e.g., dielectric constant), and thus induce coalescence of like phases to effect emulsion breaking, dewatering, desalting or a combination thereof. Furthermore, unlike demulsifiers which are consumed during the process, the active agent is not consumed and may be recovered and recycled within the process. Demulsifiers are typically added to the feed in small amounts e.g., less than about 1% by volume of the feed or in parts per million amount with respect to the amount of the feed.

In various embodiments, measures of the degrees of solubility of the active agent in the hydrocarbon component of the hydrocarbon feed include dielectric property of the active agent (i.e., dielectric constant of the active agent). In general, the closer the dielectric constant of the active agent is to the dielectric constant of the hydrocarbon, the higher the solubility of the active agent in the hydrocarbon.

The dielectric property of a suitable active agent for use according to the methods of the present invention may range in value between the dielectric property value of water and the dielectric property value of the hydrocarbon component at particular processing conditions. For example, the dielectric property value of the active agent may range between about 88, the dielectric constant of water at 0° C., and about 4, the dielectric constant of bitumen diluted in naphtha at 20° C.

In various embodiments, modulation of the dielectric constant may involve modulation of the dielectric constant of the active agent (e.g., active agents having various compositions and thus various relative solubilities in the aqueous component and the hydrocarbon component of the feed), modulation of the dielectric constant of the bulk aqueous component of the hydrocarbon feed resulting from diffusion of the active agent into the aqueous component, or a combination thereof.

The degree of solubility of the active agent in the hydrocarbon component of the hydrocarbon feed and in the aqueous component of the hydrocarbon feed may be modulated by modulating the properties (e.g. composition) of the active agent, the operating parameters (e.g., temperature, pressure) or a combination thereof prior to the introduction of the active agent into the hydrocarbon feed, and at any stage of the process. Various active agent modulating means may be used to modulate the properties of the active agent such as, for example, a chamber comprising an inlet and a valve for metered introduction of one or more active agents (e.g., recycled active agent, new agents) and modifiers such as water for mixing to produce a suitable composition of the active agent for treating a particular feed under particular operating conditions. Different modulating means may be used at different stages of the process.

In various embodiments, the active agent may be a liquid, gas or a mixture of liquid and gas. For example, in selected embodiments, the active agent may be mixed with the hydrocarbon feed as a liquid or permeated though the hydrocarbon feed as a gas. In various embodiments, the phase of the active agent may be also modulated at various stages of the process. For example, initially the active agent may be introduced into the feed as a gas, and by modulating operating conditions such as temperature for example, the active agent may be caused to become a liquid in the feed at a subsequent stage of the process.

In various embodiments, suitable active agents may comprise a protic active agent which may comprise one or more electronegative atoms (e.g., fluorine, oxygen, nitrogen or chlorine). In various embodiments, one or more dipolar aprotic compounds may be used if combined with the protic active agent to form an active agent composition having suitable solubility in the hydrocarbon and aqueous components of the hydrocarbon feed. In various embodiments, the protic active agent may comprise an alcohol (primary, secondary, tertiary), combinations of various alcohols, or alcohol/water mixtures having varying ratios of alcohol to water. Examples of suitable protic active agents include methanol, ethanol, propanol, butanol, pentanol, glycerol and various glycols (e.g., ethylene glycol), a combination of various protic active agents, and a combination of various protic active agents with varying ratios of water in order to tailor the chemical properties of the active agent to the properties of the particular hydrocarbon feed to be treated (e.g., to modulate degree of solubility of the active agent in the hydrocarbon component of the hydrocarbon feed) and the desired efficiency for emulsion breaking, dewatering, desalting, or a combination thereof. In various embodiments, alcohols suitable as active agents are alcohols having 1 to 6 carbon atoms. In various other embodiments, alcohols suitable as active agents are alcohols having 1 to 6 carbon atoms in a linear chain. In further various embodiments, alcohols suitable as active agents are alcohols having 1 to 4 carbon atoms. In various other embodiments, alcohols suitable as active agents are alcohols having 1 to 4 carbon atoms in a linear chain. In embodiments in which the active agent composition comprises alcohols having more than 6 carbon atoms, such compositions preferentially comprise sufficient amounts of alcohols having 1 to 6 carbon atoms such that the composition has a suitable relative solubility in the aqueous component and in the hydrocarbon components of the feed.

In embodiments in which a suitable active agent composition comprises active agents comprising alcohols having 1 to 6 carbon atoms or 1 to 4 carbon atoms with active agents comprising alcohols having more than 6 carbon atoms, a staged diffusion of the components of the composition may be effected to progressively change the dielectric properties of the aqueous components. For example, the more polar shorter alcohols may diffuse into the aqueous component first and change the properties of the aqueous component, as a result of which the longer more non-polar alcohols may subsequently diffuse into the modified aqueous component to further change its dielectric property. Thus, in various embodiments, a succession of active agents may diffuse into the aqueous component as properties of the aqueous component change.

The amount of the active agent required to treat the hydrocarbon feed will be at least the amount of the active agent feed required to effect in the aqueous component-in-hydrocarbon emulsion emulsion breaking, dewatering, desalting, or a combination thereof. In various embodiments, the active agent composition comprises a concentration of the active agent in a mixture of the active agent and a modifier such as water in the range of about 0.1 to about 1 wt. %, about 1 to about 10 wt. %, about 10 to about 20 wt. %, about 20 to about 50 wt. %, about 50 to about 80 wt. %, about 80 to about 99 wt. %, or about 99 to about 99.9 wt. % of the active agent.

In various embodiments, the amount of the active agent may be at least about 1 to about 5 wt. %, about 5 to about 20 wt. %, about 20 to about 50 wt. %, about 50 to about 75 wt. %, about 75 to about 80 wt. %, about 80 to about 90 wt. %, about 90 to about 95 wt. %, or about 95 to about 100 wt. % of the amount of water present in the hydrocarbon feed.

In embodiments where the initial hydrocarbon feed is substantially free of water and comprises salts dispersed in the oil, prior to a wetting pre-treatment to form a water-in-hydrocarbon emulsion and the addition of the active agent, a suitable amount of the active agent relative to the amount of salts present in the hydrocarbon feed is such that the effective weight percent of salt in the active agent is below the solubility limit of the salt in the active agent at the process conditions.

In various embodiments, suitable ratios of the active agent to hydrocarbon may be in the range of about 1:20, about 1:10, about 1:5, about 1:1, about 2:1, about 5:1 or higher. Suitable ratios, however, may be further modulated depending on the properties of the active agent relative to the properties of the hydrocarbon feed. In selected embodiments, economics of the process may be a factor in selecting a suitable ratio as higher ratios require larger process units and larger volumes of active agents to circulate.

In various embodiments, the volume ratio of the components in the active agent is such that the sum of volume fraction ($V_i$) multiplied by dielectric constant ($\in_i$) for the active agent (where i=1 to n for active agent component 1, 2, 3, etc.) and water falls between the values of the dielectric constants of the hydrocarbon ($\in_h$) and water ($\in_w$) at process conditions. This is expressed mathematically by Formula 1.

$$\varepsilon_h < \sum_i \varepsilon_i V_i < \varepsilon_w \qquad \text{(FORMULA 1)}$$

A suitable mixture of the active agents, or the active agent and water, is such that the resulting dielectric constant of the mixture is within about plus or minus five units of the value of the dielectric constant of any other suitable active agent at the same process conditions.

Suitable active agents for use in various embodiments of the present invention may be identified as those having one or more of the following properties: good solubility for salts (e.g., for NaCl) particularly at low active agent/hydrocarbon feed ratios; high density contrast with the hydrocarbon feed to facilitate rapid gravity separation; minimal stable emulsion formation tendency with the hydrocarbon feed to facilitate rapid separation from the hydrocarbon feed phase; relatively low mutual solubility with the hydrocarbon feed, at selected operating conditions, to facilitate high recovery of the active agent from the hydrocarbon feed; suitable viscosity for effective mixing and contacting with the hydrocarbon feed; comprise substantially no harmful hetero-atoms for benign downstream processing; have suitable dielectric constants (polarity) relative to water and to the particular hydrocarbon feed to be processed at the selected operating conditions and stages of the process; and do not form undesirable by products with the species found in the hydrocarbon feed. Table 1 shows examples of active agents having certain dielectric constants, which may be suitable for processing hydrocarbon feeds.

TABLE 1

| Active Agent | Dielectric Constant (1) | Relative Polarity |
|---|---|---|
| Water | 78.85 | Most polar |
| Glycerol | 42.5 | |
| Ethylene glycol | 37.7 | |
| Methanol | 32.63 | ⇩ |
| Ethanol | 24.3 | |
| 1-propanol | 20.1 | |
| 1-butanol | 17.1 | |
| 1-pentanol | 13.9 | |
| Hydrocarbon feed (dilbit) | 3.7 | Least polar |

Notes:
(1) Approximate values at 25° C.

In various embodiments, active agents exhibiting one or more of the above properties may be further modified with other active agents or with water to achieve chemical properties that will allow the desired levels or efficiencies of emulsion breaking, dewatering, desalting, or a combination thereof for treating a particular hydrocarbon feed under particular operating conditions. Examples of such modification using water are presented in the EXAMPLES section. In various embodiments, one or more of the active agents may be present in the input hydrocarbon feed and may combine with additional active agents added to the feed to achieve an active agent mixture with properties (e.g., dielectric constant) suitable for achieving emulsion breaking, dewatering, desalting or a combination thereof at the particular operating conditions and stages of the process.

In various embodiments, the treatment of the hydrocarbon feed to effect emulsion breaking, dewatering, desalting or a combination thereof may be performed in one or more stages, using tailored process conditions for the hydrocarbon feed of each stage, to achieve progressive emulsion breaking, dewatering, desalting or a combination thereof.

Referring to FIG. 1, there is shown a first embodiment of a system 10 adapted for treating the hydrocarbon feed to effect emulsion breaking, dewatering, deslating, or a combination thereof. In the embodiment illustrated in FIG. 1, the hydrocarbon feed is introduced through line 1 and the active agent is introduced through line 2, in a counter-current or co-current manner, into a mixing valve or contactor 13 where turbulence is sufficient to produce a mixed feed having the active agent phase substantially dispersed within the hydrocarbon feed and also dissolved in the hydrocarbon feed to a desired degree. The active agent introduced into the contactor 13 has a flow rate achieves sufficient dispersion of the active agent in the hydrocarbon feed. In this embodiment, the active agent and the hydrocarbon feed may also have any suitable temperatures so long as the pressure is sufficiently high to maintain the active agent and the hydrocarbon feed in the liquid phase and to maintain the desired degree of solubility of the active agent in the hydrocarbon feed at the selected operating conditions. In various embodiments, mixing of the hydrocarbon feed with the active agent to produce a treated feed may also be effected using mixing means comprising static mixers, injectors, nozzles or tank mixers with impellers, turbines, propellers or paddles, or other high sheer mechanical devices with or without energy input. Any mixing means for producing the treated feed is suitable for use in the present invention (e.g., an inline device) as long as effective distribution of the active agent within the hydrocarbon feed may be achieved.

In the embodiment shown in FIG. 1, the mixed or treated feed comprising the active agent is carried through line 3 into a separator 4, where phase separation occurs within a certain time to produce a used active agent phase 6, and a hydrocarbon phase 7 depleted in water, salt, or both water and salts, the hydrocarbon phase 7 being distinct from the used active agent phase, water phase or both depending on the number of stages in the process. In selected embodiments, the used active agent phase 6 may either float on top of the hydrocarbon phase 7 or vice versa depending on the choice of the active agent for a particular treatment. Table 2 shows densities of various active agents relative to the density of the hydrocarbon phase (i.e., dilbit in this example).

TABLE 2

| Active Agent | Dielectric Constant | NaCl Solubility (wt. %) (1) | ρ (g/mL) | Δρ(active agent hydrocarbon feed) | |
|---|---|---|---|---|---|
| Water | 78.85 | 26.4 | 1.00 | 0.06 | ⇧ |
| Glycerol | 42.5 | 1.2 | 1.26 | 0.32 | |
| Ethylene glycol | 37.7 | 1.2 | 1.11 | 0.17 | Hydrocarbon feed floats |
| Methanol | 32.63 | 1.3 | 0.79 | −0.15 | Hydrocarbon feed sinks |
| Ethanol | 24.3 | 0.065 | 0.79 | −0.15 | |
| 1-propanol | 20.1 | 0.012 | 0.80 | −0.14 | |
| 1-butanol | 17.1 | 0.014 | 0.81 | −0.13 | ⇩ |
| 1-pentanol | 13.9 | 0.002 | 0.82 | −0.12 | |
| Hydrocarbon feed (dilbit) | 3.7 | — | 0.94 | 0.00 | |

Notes:
(1) Solubility in temperature range from about 20 to about 25° C.

In various other embodiments, the active agent and the hydrocarbon feed may also be contacted directly in the separator 4 for both mixing to produce a treated feed and for subsequent separation. Examples of separators suitable for the use in various embodiments of the present invention include conventional separators such as for example an inclined plate separator, a tank, or dynamic separators, including an inline device, promoting coalescence of the two like phases to facilitate separation. Enhanced gravity separators such as centrifuges and hydrocyclones are also useful where space is limited or more intense dispersion of the active agent in the hydrocarbon feed is utilized.

In selected embodiments, staged mixing to produce a treated feed and separation may take place with the addition of one or more of the active agents at each stage to tailor the properties of the active agent to the changing properties of the hydrocarbon feed to maximize emulsion breaking, dewatering, desalting, or a combination thereof. Furthermore, operating conditions may be adjusted at each stage to maximize the efficiency of the active agent at each of the processing stages.

In the embodiment shown in FIG. 1, the used active agent phase 6 exits the separator 4 through line 7 and through a valve 19 into an active agent phase separator 9 for recovery where the used active agent phase 6 may be further processed in a conventional manner (e.g., distillation) to obtain a recovered active agent. As is shown in the embodiment in FIG. 1, in some embodiments, the water, salts, or a combination thereof may also be recovered through line 12 from the bottom of the active agent phase separator 9 for waste disposal or other use. The recovered active agent exits the active agent phase separator 9 through line 21 for further processing, reuse within the system 10, disposal or other uses. In the embodiments in which the recovered active agent is recycled into the system 10, make-up active agent may be added to the system 10 through line 22 as is illustrated in FIG. 1 for example to modulate the properties of the recovered active agent, or alternatively the recovered active agent may be used to modulate the properties of the make-up active agent.

In various embodiments, the used active agent phase 6 may comprise water in the range of about 0 to about 99 wt. %, salt concentration in the range about 0 to their limiting solubility at stream conditions or a combination thereof.

Figure 2:
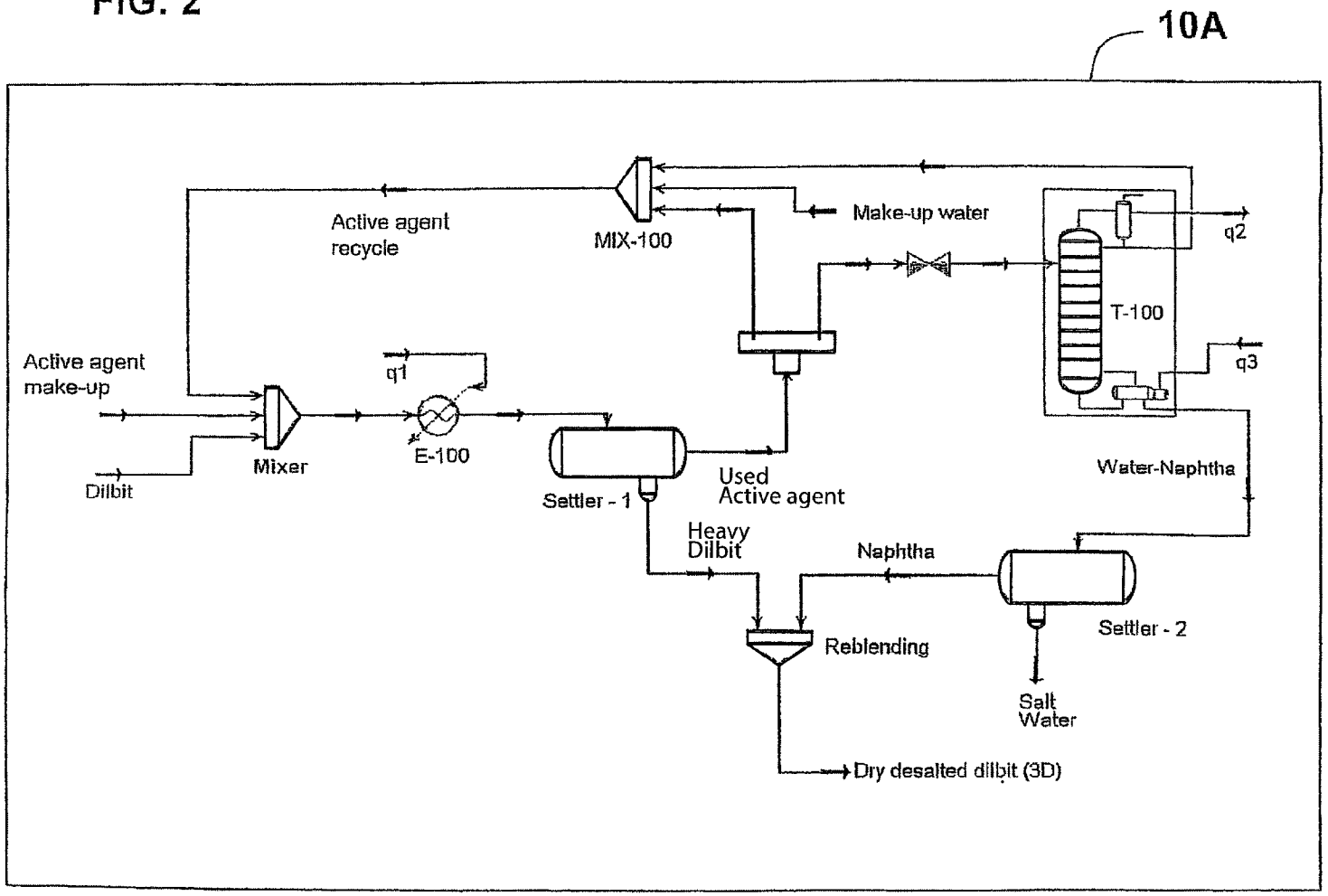
FIG. 2 illustrates a schematic diagram of system 10A according to another embodiment of the invention.

In the embodiment in FIG. 1, the hydrocarbon phase 5 is heavier than the used active agent phase 6, and exits the separator 4 through line 8. In selected embodiments, the hydrocarbon phase 5 may be warmed using a heat exchanger 14 for example. The hydrocarbon phase 5 may be further sent to a hydrocarbon phase separator vessel 16 for recovery of hydrocarbons through line 18 for example, in which any residual active agent, water or both in the hydrocarbon phase 5 may be stripped, for example, by heating. In various embodiments the hydrocarbon phase 5 may comprise water in the range of about 0 to about 0.5 wt. %, salt concentration in the range of about 0 to about 10 ppm depending on the level of water and salt removal required or a combination thereof. FIG. 2 shows another embodiment of the invention (system 10A) with dilbit as an example of the hydrocarbon feed with a particular processing circuit design.

Figure 3:
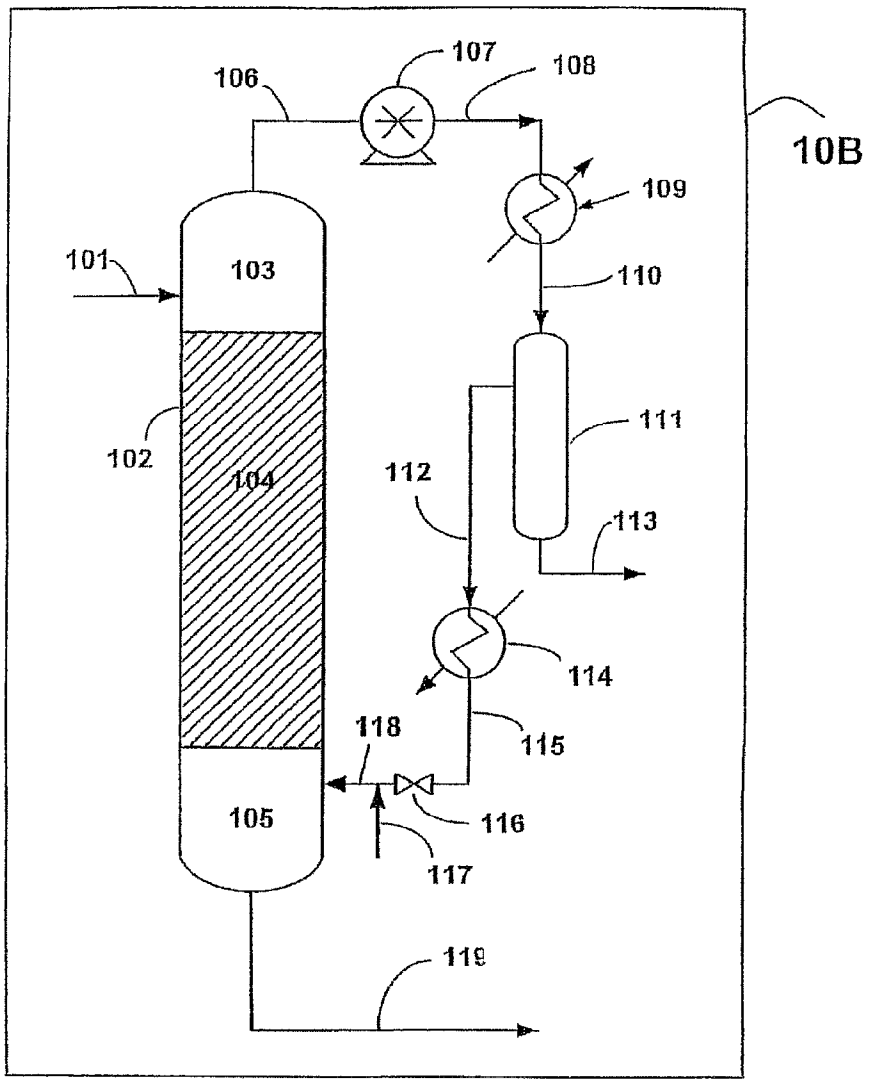
FIG. 3 illustrates a schematic diagram of system 10B according to another embodiment of the invention.

In yet another embodiment, as shown in FIG. 3 (system 10B), the hydrocarbon feed is introduced through line 101 into a counter-current liquid-liquid contactor 102. Contactor 102 may have an active agent disengagement zone 103 where the active agent is withdrawn above the point where the hydrocarbon is introduced, packing 104 to enhance contacting of the hydrocarbon feed with the active agent to produce a treated feed, and a disengaging zone 105 where the active agent is introduced above the disengagement zone such that hydrocarbon feed depleted in water, salts or a combination thereof can be withdrawn following separation within a certain time. Suitable packing 104 may include unstructured or dumped packing (e.g., saddles and rings), structured or arranged packing (e.g., trays, cartridge and grids). The packing 104 may be chosen to further enhance emulsion breaking, dewatering, desalting or a combination thereof in addition to the action of the active agent and the influence of operational parameters. The active agent may enter the contactor 102 through line 118 while a required make-up active agent may enter through line 117. Due to density differences between the active agent and the hydrocarbon feed, the more dense hydrocarbon feed may flow down the contactor 102 and the less dense active agent may rise upward through the contactor 102 resulting in the active agent contacting the hydrocarbon feed for treatment. In embodiments where the active agent is more dense than the hydrocarbon feed, the active agent may be introduced into zone 103 and the hydrocarbon feed may be introduced into zone 105 and the active agent recovery is reconfigured accordingly.

In another aspect, various configurations of the contactor 102 may be employed including (1) single or multiple stages of conventional mixer settler vessels, (2) pulsed columns, (3) mechanically agitated columns and (4) centrifugal extractors in a variety of operational modes (e.g., once-through mode or continuous recycle mode). In various embodiments, one or more contactors 102 may be used in various configurations to effect tailored processing, including staged processing, of various hydrocarbon feeds having various concentrations of water or salts to effect emulsion breaking, dewatering, desalting or a combination thereof.

In the embodiment shown in FIG. 3, the active agent phase following separation (i.e., used active agent phase) exits the contactor 102 through line 106 which may be connected to a pump 107. The used active agent phase enters an active agent phase separator 111 in which the used active agent phase may be further processed. The recovered active agent exits the separator 111 through line 112 for further processing, recycling into the system 10B, disposal, or other use. The water, salts or a combination thereof exit through line 113 to waste disposal or for other uses.

In various embodiments, effective dispersion of the active agent in the hydrocarbon feed is desirable so that the active agent (e.g., active agent droplets in some embodiments) can collide with water droplets or saline water droplets and cause coalescence and separation of the water phase, the active agent phase or both depending on the stage of the process from the hydrocarbon feed. Dispersion of the active agent in the hydrocarbon feed also serves to achieve a certain degree of dissolution of the active agent in the hydrocarbon. Through diffusion processes, the active agent, having a certain degree of solubility in the hydrocarbon, migrates to the interface of the emulsified water in the hydrocarbon and thereby alters the properties of the water, such as dielectric constant, and thereby the properties of the water-hydrocarbon interface (e.g. interfacial tension) so as to facilitate droplet-droplet coalesce and separation of the emulsified water, and in selected embodiments, removal of salts from the hydrocarbon phase of the hydrocarbon feed. In embodiments where salts are dispersed as fine solids in the hydrocarbon feed, e.g., due to thermal removal of water as in dehydrated hydrocarbon feeds, the hydrocarbon feed may be pretreated to form a water-in-hydrocarbon emulsion for subsequent processing according to various methods and apparatuses of the present invention. In other embodiments, in which salts are dispersed as fine solids in the hydrocarbon feed, e.g., due to thermal removal of water as in dehydrated hydrocarbon feeds, the hydrocarbon feed may be pretreated to form a water-in-hydrocarbon emulsion for subsequent processing according to the various method and apparatus of the present invention.

The following non-limiting examples demonstrate reduction to practice of the present invention.

EXAMPLES

Example 1

Interfacial Tension Measurements

Interfacial tension (IFT) measurements were performed between various active agents (e.g., methanol or methanol/water mixtures) and the hydrocarbon feed (e.g., dilbit) as a parameter for determining whether a barrier to coalescence of the active agent droplets and water droplets in the hydrocarbon feed which have been modified by addition of the active agent will exist over a range of temperatures and compositions of the active agent. IFT with dilbit-water was measured to show that in a conventional desalting process, where water is used, the barrier to coalescence would be high compared to the processes of the present invention employing the active agent.

The pendant drop method (as disclosed in Bihai Song and Jurgen Springer, Determination of Interfacial Tension from the Profile of a Pendant Drop Using Computer-Aided Image Processing 1. *Theoretical, Journal of Colloid and Interface Science* 184 (1) 64-76 1996, and references therein) was used to determine the interfacial tensions between the hydrocarbon feed and the various active agents. A pendant drop of the hydrocarbon feed was suspended in the active agent and was monitored as a function of time by video camera. Analysis of the suspended droplet shape yielded the interfacial tension. It was not possible to carry out the measurements in the reverse manner by having a pendant drop of the active agent suspended in the hydrocarbon feed due to the requirement that the droplet be visible.

At temperatures from about 23° C. to about 74° C., the initial values of IFT between dilbit and water were found to be in the range of about 18 mN/m to about 26 mN/m. The initial values of IFT were found to decrease with increasing temperature. Over a period of about 24 hours, the IFT at a given temperature decreased from its initially high value and approached an equilibrium valued between about 12 mN/m and about 15 mN/m. Regardless of the temperature, the IFT appeared to approach equilibrium values at about the same rate.

Figure 4:
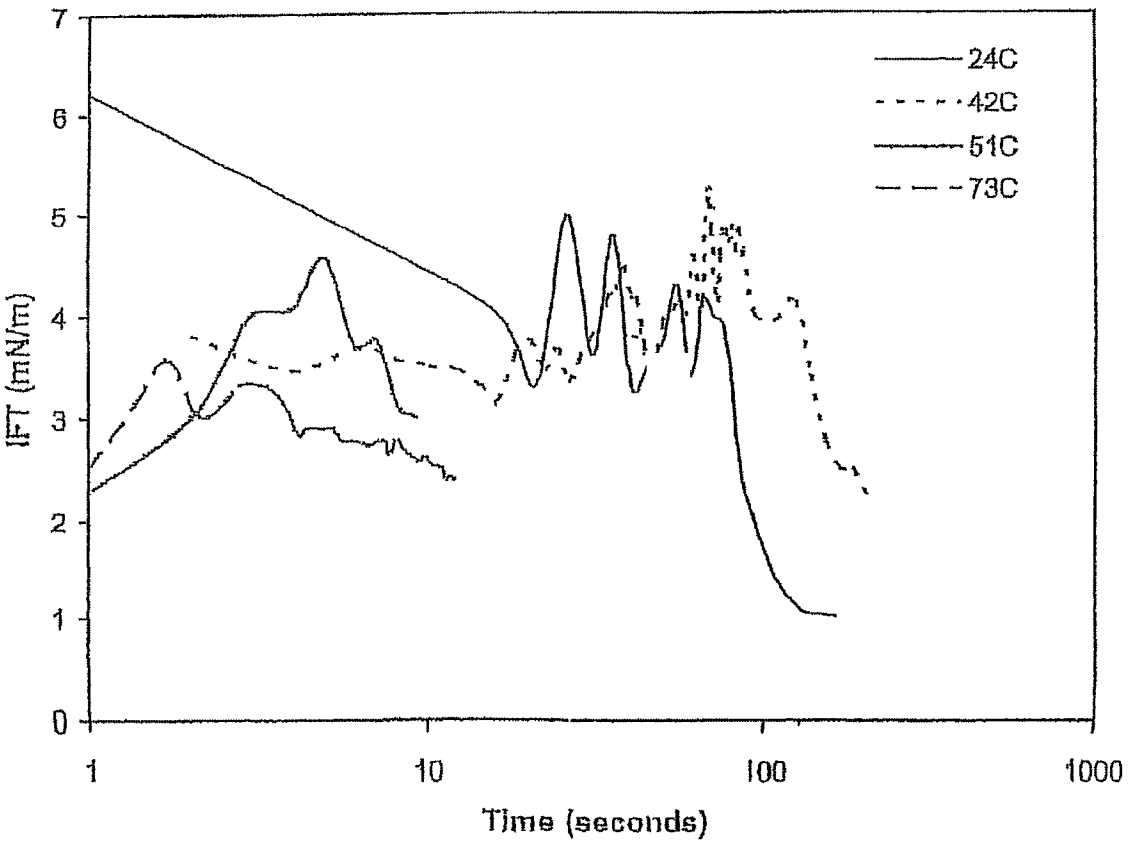
FIG. 4 illustrates results for interfacial tension at various temperatures between dilbit as a hydrocarbon feed and pure methanol as an active agent.
Figure 5:
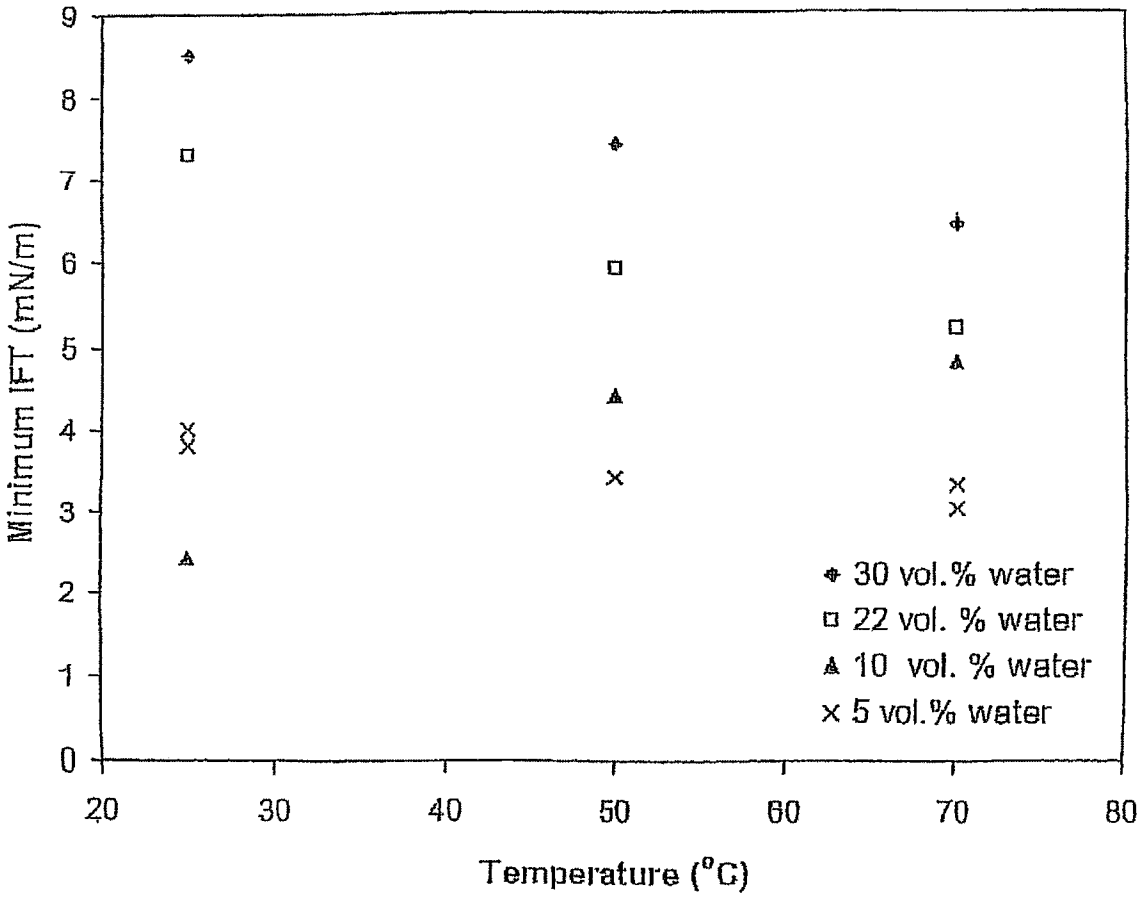
FIG. 5 illustrates results for interfacial tension at various temperatures between dilbit as the hydrocarbon feed and methanol-water mixtures as active agents.
Figure 6:
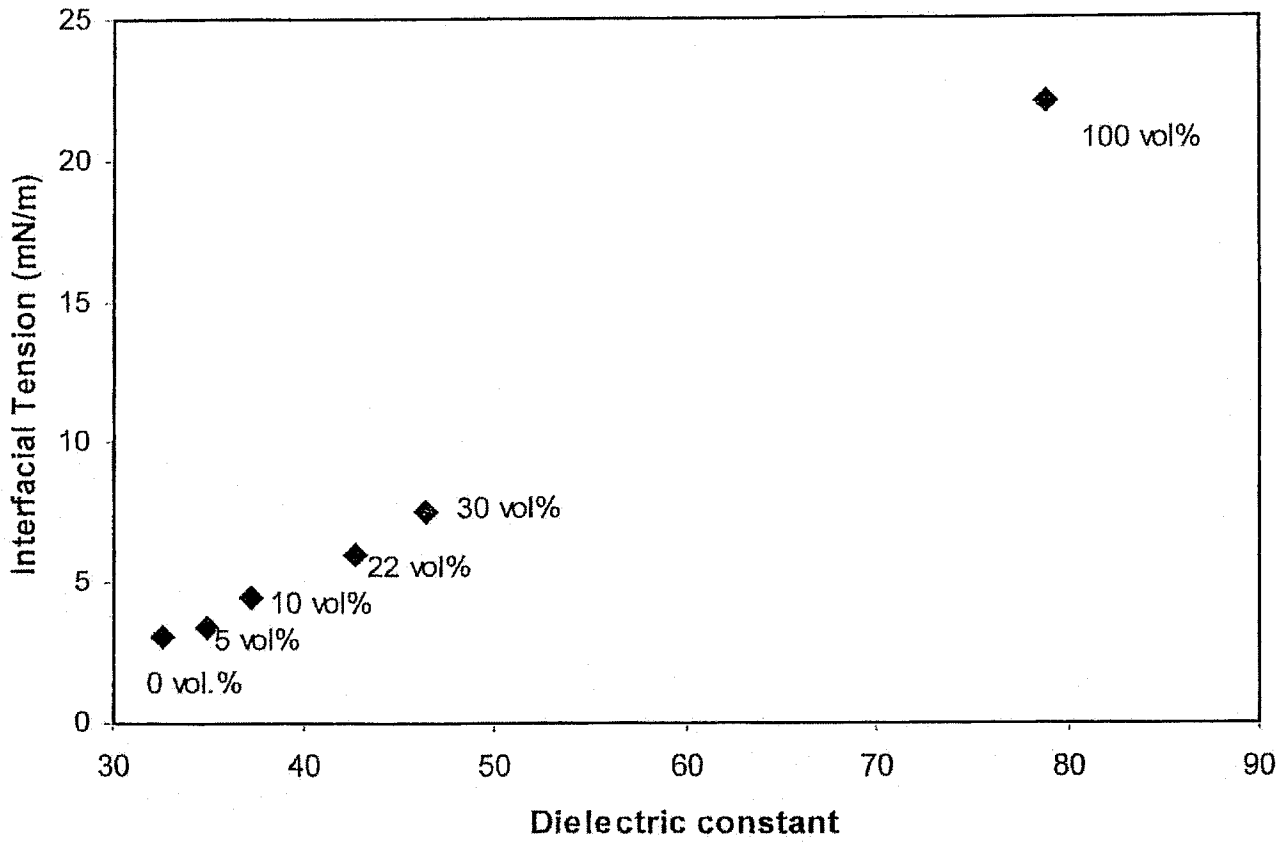
FIG. 6 illustrates results for initial interfacial tension measured at about 50° C. for methanol-dilbit with increasing vol. % of water vs. the dielectric constant of the mixture.

FIG. 4 shows the estimated IFT measurements for dilbit as the hydrocarbon feed and pure methanol as the active agent at temperatures ranging from about 24° C. to about 73° C. The variation in interfacial tension with pure methanol is due to time dependent changes in droplet size and shape due to solubility of the hydrocarbon in methanol and methanol in the hydrocarbon. FIG. 5 shows interfacial tension results for dilbit as the hydrocarbon feed and methanol-water mixtures as the active agents with varying water concentrations vs. temperature. For both methanol and methanol-water mixtures, the solubility of the naphtha fraction of the hydrocarbon feed in the active agent increased with increasing temperatures. However, the presence of increasing amounts of water appeared to suppress the solubility of naphtha in the active agent. The IFT for dilbit in a methanol-water mixture was found to be significantly lower than that for pure dilbit in water. Increasing water concentration (and dielectric constant of the mixture) resulted in increased interfacial tension as is shown in FIG. 6. Surprisingly, the results in FIG. 6 show that IFT appears to be linearly related to dielectric constant. Since these dielectric constants are linearly related to volume % water (see Formula 1), then IFT is linearly related to volume % water. The results from interfacial tension measurements show that methanol and methanol-water mixtures comprising up to about 30% vol. % water have substantially lower interfacial tensions with dilbit compared to pure water.

Example 2

Screening for Suitable Active Agents

Eight potential active agents were selected for further study as is described in Table 3. Each of these potential active agents was combined with an equal mass (about 50 g) of dilbit as the hydrocarbon feed, and then manually shaken for about two minutes at about 25° C. The resultant mixture was then centrifuged for about 30 minutes at about 3000 rpm.

TABLE 3

| Potential Active Agent | Dielectric Constant | Total Mass (g) | Potential Active Agent Layer (wt. %) | Dilbit Layer (wt. %) |
|---|---|---|---|---|
| Acetone | 20.7 | 100.52 | 96.8 | 2.4 |
| 1-Butanol | 17.1 | 101.20 | 79.4 | 20.5 |
| 2-Propanol | 18.3 | 101.34 | 64.6 | 35.2 |
| 1-Propanol | 20.1 | 101.49 | 67.5 | 32.3 |
| Ethylene Glycol | 37.7 | 100.50 | 42.7 | 46.6 |
| Furfuraldehyde | 38 | 100.65 | No separation | No separation |
| Glycerol | 42.5 | 102.34 | 56.8 | 43.1 |
| iso-Butanol | 17.7 | 102.33 | 68.9 | 31.3 |

The results shown in Table 3 show that, at the conditions studied, furfuraldehyde appears to be completely miscible in dilbit while acetone and n-butanol are both partly miscible. As is shown in Table 3, furfuraldehyde and ethylene glycol have similar dielectric constants, which are about 38 and about 37.7 respectively; however, while ethylene glycol is only partly miscible with dilbit, furfuraldehyde is completely miscible with dilbit. Acetone has a slightly higher dielectric constant (i.e., about 20.7) than the dielectric constant of isopropyl alcohol (i.e., about 18.30); however, acetone is more miscible with dilbit than is isopropyl alcohol. For comparison, at the conditions studied, the dielectric constant of water is about 79 and the dielectric constant of the hydrocarbon is about 4. In embodiments based on liquid-liquid contacting and separation of the active agent and treated demulsified hydrocarbon phase, it is desirable that the active agent has low solubility in the hydrocarbon. In other embodiments, where the active agent is primarily dissolved in the hydrocarbon and then diffuses and dissolves in the aqueous component (water droplet) and thereby alters its properties to allow separation from the hydrocarbon, the active agent with higher solubility in the hydrocarbon, which may also be modulated by process conditions, also may be used.

Five other potential active agents in Table 3 were further evaluated. The composition of the two separated phases for the five active agents was analyzed by gas chromatography. The results are summarized in Table 4 showing mutual solubilities of some potential active agents for processing the hydrocarbon feed to effect emulsion breaking, dewatering, desalting, or a combination thereof. The results summarized in Table 4 indicate that ethylene glycol and glycerol may be suitable active agents in some embodiments for emulsion breaking, dewatering, desalting or a combination of emulsion breaking, dewatering and desalting of the hydrocarbon feed. As is indicated in Table 4, the composition of the active agent layer comprised substantially the active agent, and the composition of dilbit layer comprised substantially the dilbit.

TABLE 4

| | Composition of Active Agent Layer | | | Composition of Dilbit Layer | | |
|---|---|---|---|---|---|---|
| Active Agent | Mass of Active Agent (g) | Mass of Dilbit (g) | Active Agent Recovery (%) | Mass of Active Agent (g) | Mass of Dilbit (g) | Dilbit Recovery (%) |
| 2-Propanol | 41.67 | 23.75 | 82.3 | 7.45 | 28.20 | 55.6 |
| 1-Propanol | 43.83 | 24.65 | 86.3 | 6.20 | 26.62 | 52.5 |
| Ethylene Glycol | 38.99 | 0.24 | 77.4 | 2.99 | 47.37 | 94.5 |
| Glycerol | 51.00 | 7.09 | 99.5 | 0 | 44.11 | 86.4 |
| iso-Butanol | 48.24 | 22.28 | 94.1 | 4.55 | 27.46 | 53.8 |

Additional properties of ethylene glycol and glycerol are summarized in Table 5.

TABLE 5

| Property | Glycerol | Ethylene Glycol |
|---|---|---|
| Solubility (g of NaCl/L of active agent) | 97.8 | 78.9 |
| Boiling Point (° C.) | 290 | 197 |
| Density (g/mL) | 1.261 | 1.113 |

One property of glycerol and ethylene glycol is that their densities are much higher than those of other active agents such as, for example, methanol and methanol-water mixtures. The relatively low miscibility of ethylene glycol and glycerol with dilbit may be due to these compounds having two and three alcohol (—OH) functional groups, respectively, combined with short carbon chain lengths so that they are highly hydrogen bonded with high boiling points close to or above the end point of the naphtha boiling range (or other light hydrocarbon fractions in the hydrocarbon feed), which in some embodiments may be a consideration for selecting a suitable active agent.

Example 3

Methanol as an Active Agent for Treating the Hydrocarbon Feed to Effect Emulsion Breaking, Dewatering, Desalting, or a Combination Thereof An evaluation of methanol as an active agent was undertaken by a mixing and settling test in a 250 mL beaker. The results are shown in Table 6.

TABLE 6

| Run # | T (° C.) | Contact Time (h) | Methanol/ Dilbit Ratio (v/v) | Mass Balance (%) | Methanol Recovery (%) | Dilbit Loss (%) | Cl (ug/g) (a) | TAN (mg KOH/g) |
|---|---|---|---|---|---|---|---|---|
| dilbit | — | — | — | — | — | — | 6.53 | 2.13 |
| 1 | 22.4 | 24 | 2:1 | 99.5 | 103.9 | 6.5 | 2.01 | 1.61 |
| 2-1 | 25.1 | 1 | 2:1 | 99.7 | 105.4 | 9.1 | 2.31 | 1.68 |
| 2-2 (b) | 24.8 | 1 | 2.8:1 | 99.7 | 80.6 | — | 1.76 | 0.67 |
| 3 | 50.6 | 1 | 2:1 | 99.6 | 106.0 | 10.0 | 2.04 | 1.51 |
| 4 | 61.0 | 1 | 2:1 | 99.6 | 106.6 | 11.1 | 1.69 | 1.46 |
| 5 | 27.6 | 1 | 1:10 | 99.5 | 0.0 (c) | — | 6.01 | 2.06 (c) |
| 6 | 25.0 | 1 | 1:1 | 99.8 | 104.3 | 3.6 | 3.11 | 1.69 |
| 7 | 24.4 | 1 | 1.5:1 | 99.6 | 105.0 | 6.3 | 2.95 | 1.6 |

Notes:
(a) Methanol as received contained 0.3 ug/g of chloride (Cl)
(b) Oil from 2-1 was treated with a fresh aliquot of methanol Methanol was dispersed in the dilbit not dissolved as it could be separated by centrifugation Methanol was found to be effective for emulsion breaking, dewatering and removal of chloride. Methanol was also found effective for reducing the total acid number (TAN) of the hydrocarbon feed. The solubility of dilbit hydrocarbon fractions in methanol was estimated from methanol recoveries assuming no loss of methanol to the dilbit. The solubility of some fraction of the dilbit in methanol increased slightly with temperature and decreased with decreasing methanol/dilbit ratio. With increasing methanol/dilbit ratios from about 1:1 to about 2:1, chloride content in the treated hydrocarbon feed was found to decrease. At a low methanol/dilbit ratio of about 1:10, the methanol was dispersed in the hydrocarbon feed and no separation on standing was observed. With increasing temperature from about 25° C. to about 60° C. and a methanol/dilbit ratio of about 2:1, chloride removal from dilbit increased slightly.

A test at about 25° C. was performed where the oil dilbit was treated at a ratio of about 2:1 methanol/dilbit and the recovered dilbit was then treated with a second aliquot of fresh methanol. In this embodiment, the chloride content of the hydrocarbon feed was further reduced from about 2.31 ppm to about 1.76 ppm. The fraction reduction in the chloride content was about 65% in the first step and further reduction of about 24% in the second step resulting in an overall chloride removal of about 89%. The TAN content was also reduced in the second stage of treatment.

Figure 7:
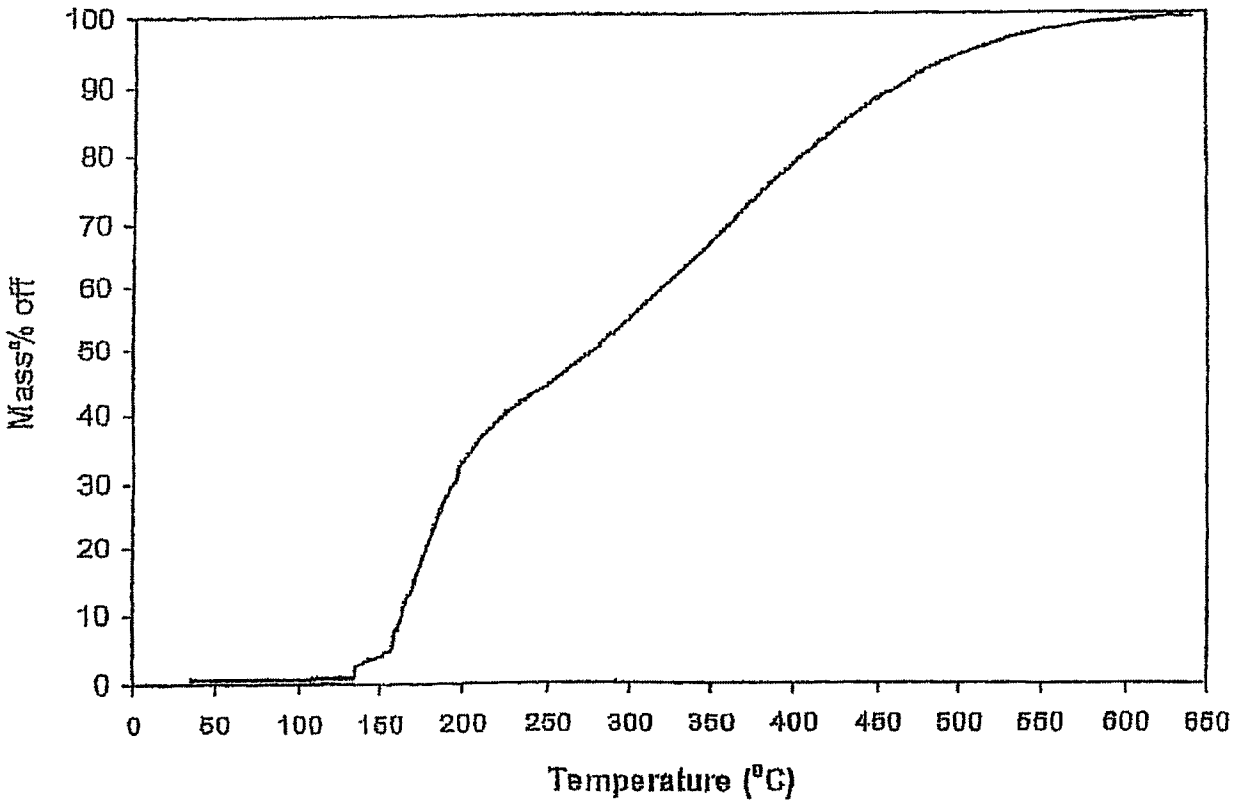
FIG. 7 illustrates results for simulated distillation of methanol extract from dilbit using pure methanol at about 25° C. (after methanol removal by spinning band distillation)

The fraction of dilbit extracted at about 25° C. into the methanol from a test with a ratio of about 2:1 methanol/dilbit was recovered and analyzed. About 5.4 wt % of dilbit was found to be dissolved in methanol at about 25° C. In this test, the fraction of the initially charged dilbit extracted by methanol was about 9 wt % of the initially charged dilbit. A fraction of the extract was distilled to remove most of the methanol by spinning band distillation. The simulated distillation curve for the methanol-free extract is shown in FIG. 7. The refined extract comprised approximately 12% naphtha (BP< about 166° C.), about 36% kerosene (BP about 166-271° C.) and the balance was gas oils (BP about 271-525° C.) and about 3%+525° C. resid. The extract also comprised a TAN of about 8.4 mg-KOH/g-oil, which was consistent with the observed reduction in TAN of the treated dilbit.

Following the shaker tests, a batch static mixer-settler apparatus was used to perform further controlled desalting of the dilbit sample using methanol as the active agent. Seven tests were conducted at temperatures of about 25° C., about 50° C., and 70° C. with methanol/dilbit ratios of about 1:10, about 1:1, and about 2:1. The results are summarized in Table 7.

At a temperature of about 50° C. and about 70° C., a higher ratio of methanol/dilbit moderately increased the removal of chlorides. A higher methanol to dilbit ratio also increased the amount of hydrocarbon extracted into the methanol phase which is reflected in the viscosity of the treated oil.

TABLE 7

| Run # | Dilbit | 2 | 3 | 4 | 5 | 6 | 7 | 8 |
|---|---|---|---|---|---|---|---|---|
| Ratio (vol/vol) | untreated | 1:1 | 2:1 | 1:1 | 1:10 | 1:1 | 2:1 | 1:10 |
| Temperature (° C.) | untreated | 50 | 50 | 70 | 70 | 25 | 25 | 25 |
| Processed dilbit TAN (mg KOH/g) | 2.13 | 1.31 | 1.23 | 1.68 | 1.31 | 0.94 | 1.65 | 2.32 |
| [Cl] (μg/g) | 7.05 | 2.01 | 1.54 | 2.01 | 4.85 | 2.35 | 3.44 | 5.39 |
| Cl Reduction (%) | — | 71.5 | 78.2 | 71.5 | 31.2 | 66.7 | 51.2 | 23.5 |
| Average dP during collection (kPa) | | 48.1 | 115.8 | 25.7 | 11.4 | 142.0 | 292.2 | 74.3 |
| Oil* Viscosity (cP) at 50° C. | 112.6 | 249.2 | 470.4 | 235.6 | 149.2 | — | — | — |

Notes:
*Treated oil recovered after the test.

Using a ratio of about 2:1 of methanol to dilbit, increased viscosity by a factor of four whereas a ratio of about 1:1 and about 1:10 increased viscosity by approximately two times and one third respectively. TAN in the treated oil decreased with an increasing methanol/dilbit ratio. TAN represents polar organic acids which are more soluble in polar active agents. Similar trends were evident at about 25° C. with some deviations in the trend in increasing chloride removal and decreasing TAN with increasing methanol/dilbit ratio. Overall, these results were similar to those observed in the shaker tests. Thus in summary, in a mixture of methanol/dilbit at a ratio of about 2:1 and a temperature of about 25° C., methanol efficiently extracts chlorides as well as about 9 wt % of the total hydrocarbon.

Example 4

Polarity of the Active Agent

Figure 8:
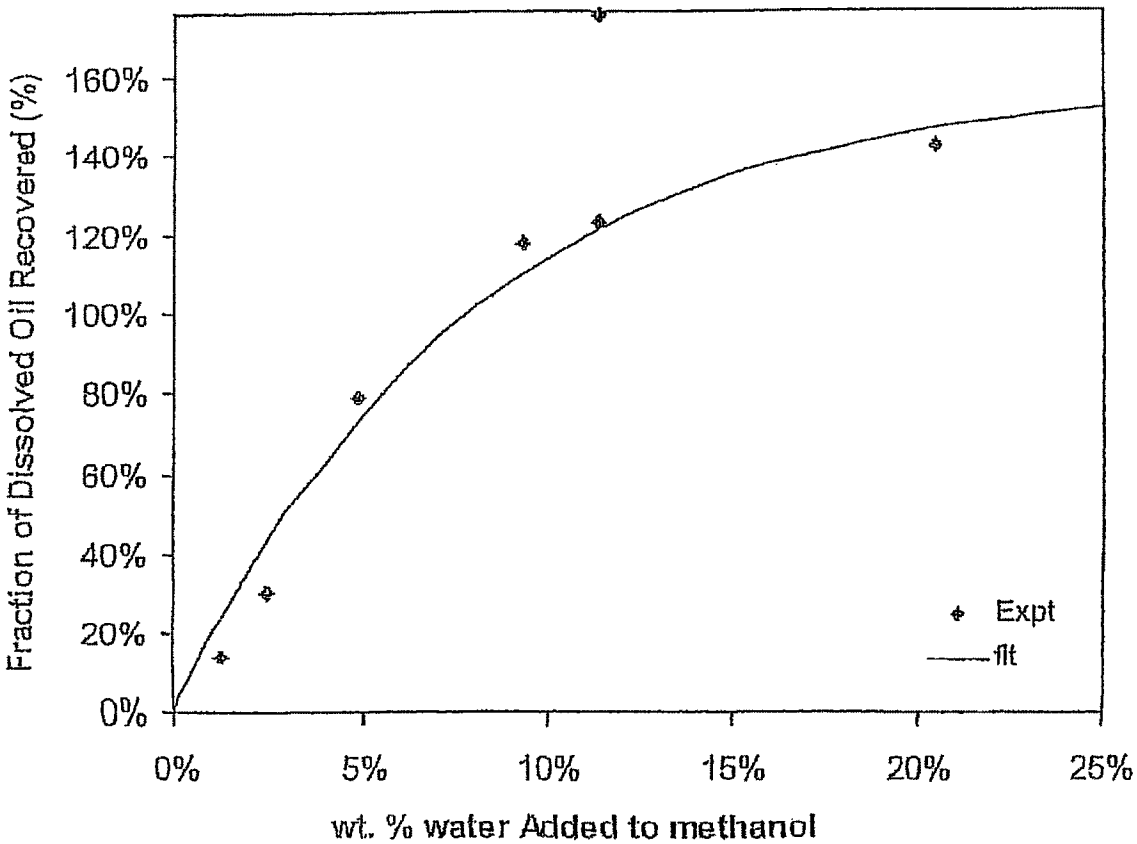
FIG. 8 illustrates results for percent recovery of the fraction of dilbit dissolved in methanol at about 20° C. vs. percent water addition to methanol.

Recognizing that methanol is less polar than water and more polar than the hydrocarbon (dielectric constant of about 32.63 for methanol vs. about 78.85 for water vs. about 4 for oil at about 25° C.), it was investigated whether increasing the polarity of the methanol extract (mixture of methanol and dissolved hydrocarbon) would cause the extracted hydrocarbon (e.g., dilbit) to separate from methanol. A methanol extract from a previous test which contained about 3.75 wt % of extracted dilbit was used. Increasing amounts of water were added to the methanol extract, and the dilbit separating from the mixture was collected and weighed. The dilbit appeared as a separate dark liquid at the bottom of the bottle. The results are shown in FIG. 8. With increasing polarity of methanol (i.e., by having a higher water content in methanol) more dilbit separated out of the mixture until a plateau was reached at about 10 wt. % to about 20 wt. % water content. The maximum amount of dilbit recovered was about 146% of the dilbit known to be dissolved in methanol.

The results indicate that modulation of the polarity of methanol or other active agents relative to the polarity of water and the hydrocarbon feed may be used to modulate the selectivity of the extraction of chlorides or other salts (e.g., extracting chlorides while mitigating the extraction of hydrocarbon fractions from the oil) and the breaking of emulsion.

An optimum polarity of the active agent may be tailored to the particular hydrocarbon feed such that an acceptable extraction of chlorides or other salts in the hydrocarbon feed, emulsion breaking, dewatering or a combination thereof may be achieved while mitigating the loss of certain hydrocarbon fractions of the hydrocarbon feed into the active agent phase separated from the hydrocarbon phase. Thus, modulating the polarity of the active agent (e.g., by the addition of water or other active agents having varying polarity) may be used to modulate the efficiency of desalting, dewatering, emulsion breaking or a combination thereof (i.e., separation of the hydrocarbon phase from the active agent phase in the active agent-hydrocarbon feed mixture) to achieve optimal results for the chemical properties of the particular hydrocarbon feed and for the operating conditions.

Modulation of an optimum methanol polarity was further investigated by manual "shake tests" for dilbit with methanol, wherein the methanol comprised varying amounts of water at about 20° C. A similar set of experiments was also completed with ethanol as the active agent. The results of the "shake tests" are shown in Table 8 at about 20° C. with the sample of dilbit comprising about 0.66 wt. % water. The initial chloride content of the dilbit was approximately 6.5 ppm.

The densities of methanol and ethanol mixtures are relatively similar, and thus density differences between oil and the active agent mixtures are approximately the same for the methanol and ethanol systems. However, methanol is significantly more polar than ethanol with dielectric constants of about 32.6 and about 24.3 for methanol and ethanol respectively.

TABLE 8

| | Active Agent Properties | | | Active Agent (g) | | Estimated | [Cl] |
|---|---|---|---|---|---|---|---|
| Alcohol | Alcohol (vol. %) | Water (vol. %) | Density (g/mL) | In | Out | Dielectric Constant | in oil (ppm) |
| Methanol | 100 | 0 | 0.791 | 50.00 | 52.15 | 32.6 | 1.9 |
| | 95 | 5 | 0.810 | 50.00 | 50.08 | 34.9 | 6.2 |
| | 90 | 10 | 0.827 | 50.06 | 49.52 | 37.3 | 1.5 |
| | 80 | 20 | 0.857 | 50.15 | 47.42 | 41.9 | 1.4 |
| Ethanol | 100 | 0 | 0.789 | 50.06 | 60.47 | 24.3 | 5.7 |
| | 95 | 5 | 0.808 | 50.08 | 54.69 | 27.0 | 4.0 |
| | 90 | 10 | 0.824 | 50.03 | 53.83 | 29.8 | 2.7 |
| | 80 | 20 | 0.853 | 50.09 | 49.02 | 35.2 | 1.9 |

The results show that pure alcohols have significant solubility for the hydrocarbon feed, with ethanol dissolving more hydrocarbons than methanol. This is consistent with the lower dielectric constant of ethanol compared to methanol. As the fraction of water in the alcohol and the mixture polarity increase, the alcohol mixture appears to dissolve less dilbit.

The decreasing solubility of hydrocarbons in the alcohols was also physically observed by a lighter color in the alcohol layer above the oil. As is shown in Table 8, increasing water content also increases the density of the alcohol and this will tend to slow the rate of alcohol-dilbit separation under gravity. The alcohol mixture begins to be lost to dilbit when the water content is between about 5 and about 10 vol. % in methanol, whereas for ethanol this occurs at between about 10 and about 20 vol. % water content.

In addition to reducing the active agent solubility in the hydrocarbon feed, the increasing water concentration results in better removal of chloride or other salts and better emulsion breaking and dewatering. In embodiments using methanol under the conditions studied, the optimal water content was about 10 vol %, however, this may change with various chemical properties of the hydrocarbon feed and operating parameters.

Figure 9:
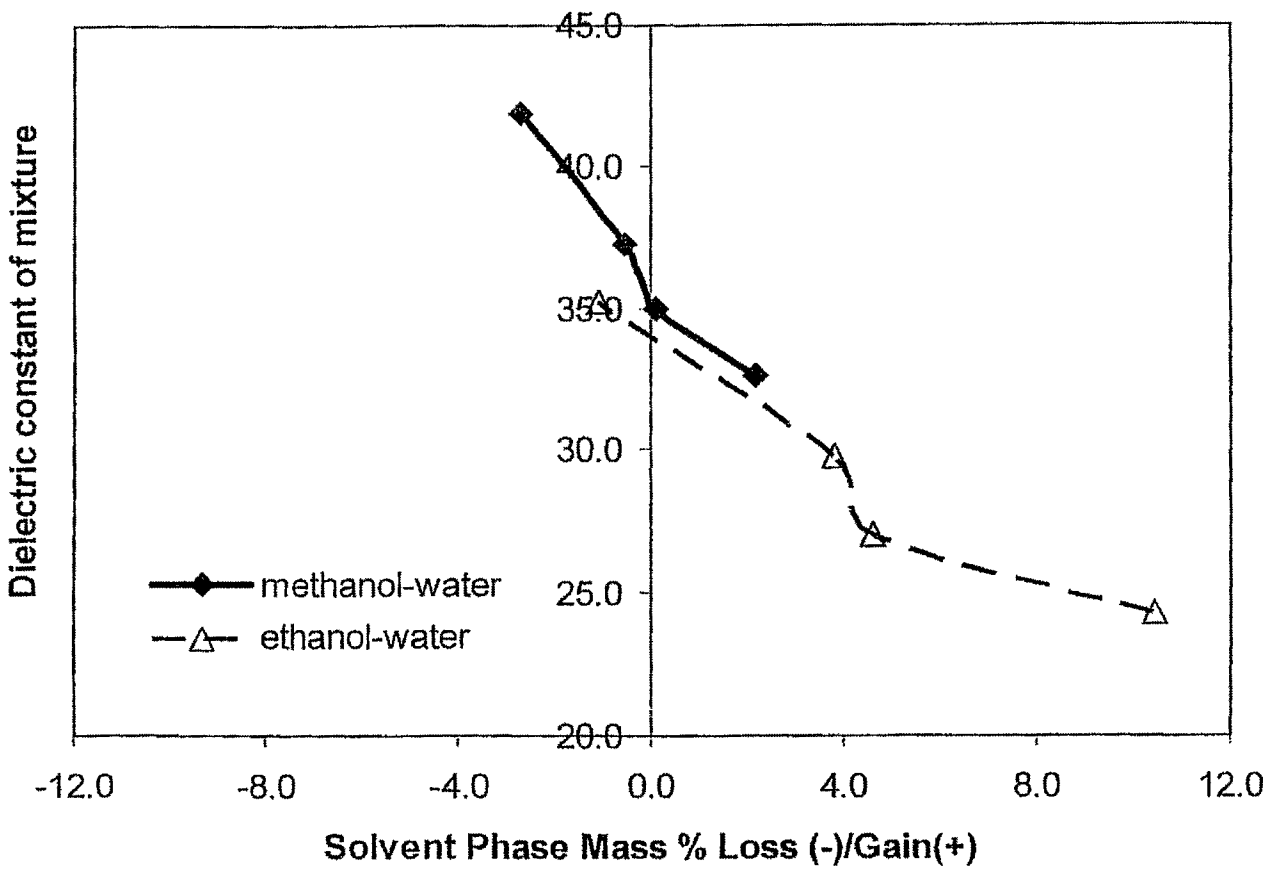
FIG. 9 illustrates results for dilbit lost to two active agents (methanol-water and methanol-ethanol) vs. dielectric constant of the particular active agent/water mixture.

Water having a dielectric constant of about 78.85 has relatively strong interactions with fine solids and asphaltenes, which lead to the formation of stable water-in-hydrocarbon emulsions when water is mixed with the dilbit. Surprisingly, it can be seen from the results in FIG. 9 that independent of the alcohol used, a portion of dilbit begins to be lost to the active agent mixture when the dielectric constant is less than about 35. In various embodiments, this result may be used in identifying various compounds as suitable active agents for emulsion breaking, dewatering, desalting, or a combination of thereof, and their potential to form stable active agent-in-hydrocarbon feed emulsions. For example, at 20° C. and for the operating conditions used to obtain the results, the optimum dielectric constant of methanol-water or ethanol-water under the conditions used should be about 35 for emulsion breaking, dewatering, desalting or a combination thereof. Since dielectric constants are functions of the temperatures, this optimum value of the dielectric constant may change with the process conditions.

Example 5

Methanol as an Active Agent for Treating Dilbit Comprising Higher water contents to effect emulsion breaking, dewatering, Desalting, or a Combination Thereof Shake tests of wet dilbit and methanol and methanol-water mixtures were conducted. For these tests, dilbit was used to prepare a hydrocarbon feedstock representative of the dilbit from a storage tank containing about 1.6 wt. % water. Tests were conducted at three dilbit/methanol ratios. The results are shown in Table 9. The initial chloride content of the dilbit was approximately 6.5 ppm

TABLE 9

| Dilbit/ MeOH Ratio | Mass In (g) | | Mass Out (g) | | Water in dilbit | Chloride in dilbit |
|---|---|---|---|---|---|---|
| (v/v) | Methanol | Dilbit | Methanol | Ditbit | (wt. %) | (ppm)* |
| 10:1 | 7.12 | 89.29 | 0.85 | 95.29 | 0.90 | 5.3 |
| 2:1 | 38.90 | 89.44 | 30.72 | 96.99 | 0.40 | 2.9 |
| 1:1 | 77.95 | 89.55 | 76.33 | 89.92 | 0.40 | 3.4 |

Notes:
*Values not corrected for carryover of methanol into the dilbit phase

The results in Table 9 indicate an apparent loss of methanol to the dilbit. For runs with dilbit/methanol ratios of about 10:1 and about 2:1, approximately 6 to 8 grams of methanol were lost to about 90 grams of dilbit. With a dilbit/methanol ratio of about 1:1, the apparent loss of methanol to the oil was only about 1.6 g. Thus, the ratio of the hydrocarbon feed to the active agent may be another consideration when choosing the appropriate conditions for achieving the desalting, dewatering, emulsion breaking or a combination thereof while minimizing loss of the hydrocarbon in the active agent phase at particular processing conditions. A suitable ratio the active agent to the hydrocarbon feed may also change with differences in the chemical makeup of the particular hydrocarbon feed.

In some experiments, chloride removal was observed to increase with decreasing dilbit/methanol ratio. For example, chloride removal with about 2:1 dilbit/methanol was slightly better than with about 1:1 dilbit/methanol ratio with this particular hydrocarbon feed. This may be due to a combination of mixing behavior and polarity of the methanol phase. A lower dilbit/methanol ratio may provide a higher extracted water content in the methanol phase which may improve chloride removal (or other salts) and the efficiency of emulsion breaking, dewatering or combination thereof. Also, a lower dilbit/methanol ratio appears to reduce the absolute amount of dilbit extracted into the methanol phase, which allows for a lower oil viscosity, better contacting and better separation.

Example 6

Methanol-Water as the Active Agent for Treating Dilbit

A shaker test of dilbit with methanol containing varying amounts of water was conducted to determine an optimal ratio of methanol to water for this hydrocarbon feed and processing conditions. Shaker tests were carried out in a shaker bath at about 25° C. and about 50° C. These shaker experiments were not designed for desalting or emulsion breaking, rather the mechanical shaking was gentle and designed to determine the equilibrium mass change for each fluid due to mass transfer between the two liquid phases. In each test, about 100 mL of active agent was shaken with about 100 mL of dilbit. The shaking duration was about 4 hours at 85 cycles per minute with a stroke length of about 2.5 cm. At the end of the test, the upper separated active agent phase was recovered by pipette while the sample temperature was maintained and the mass of the dilbit phase was determined. Due to these sample collection procedures, it is possible that vapor losses occurred and the overall mass balance ranged from about 99.3 to about 99.9° A) at about 25° C. and about 98.5% to about 99.6% at about 50° C. The mass balance generally decreased with increasing methanol concentration.

Figure 10:
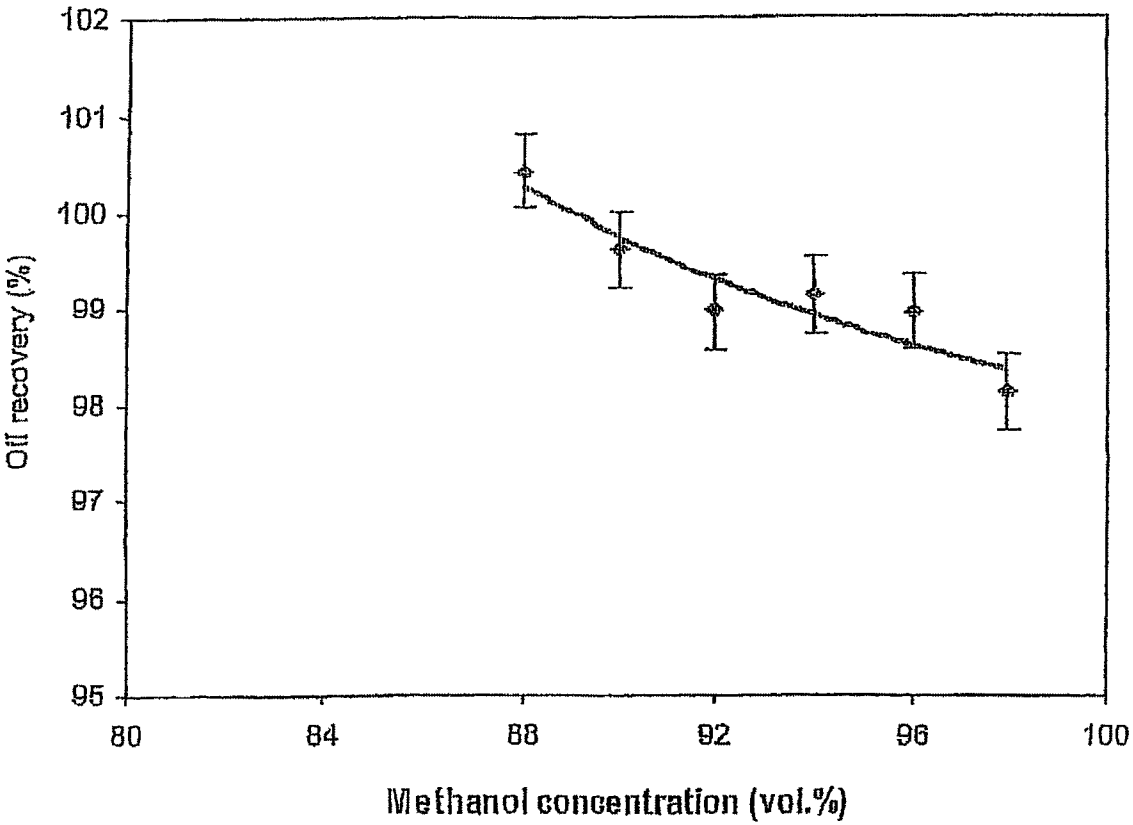
FIG. 10 illustrates results for dilbit recovery from shaker tests at about 25° C. vs. concentration of the active agent (methanol) vol. %.
Figure 11:
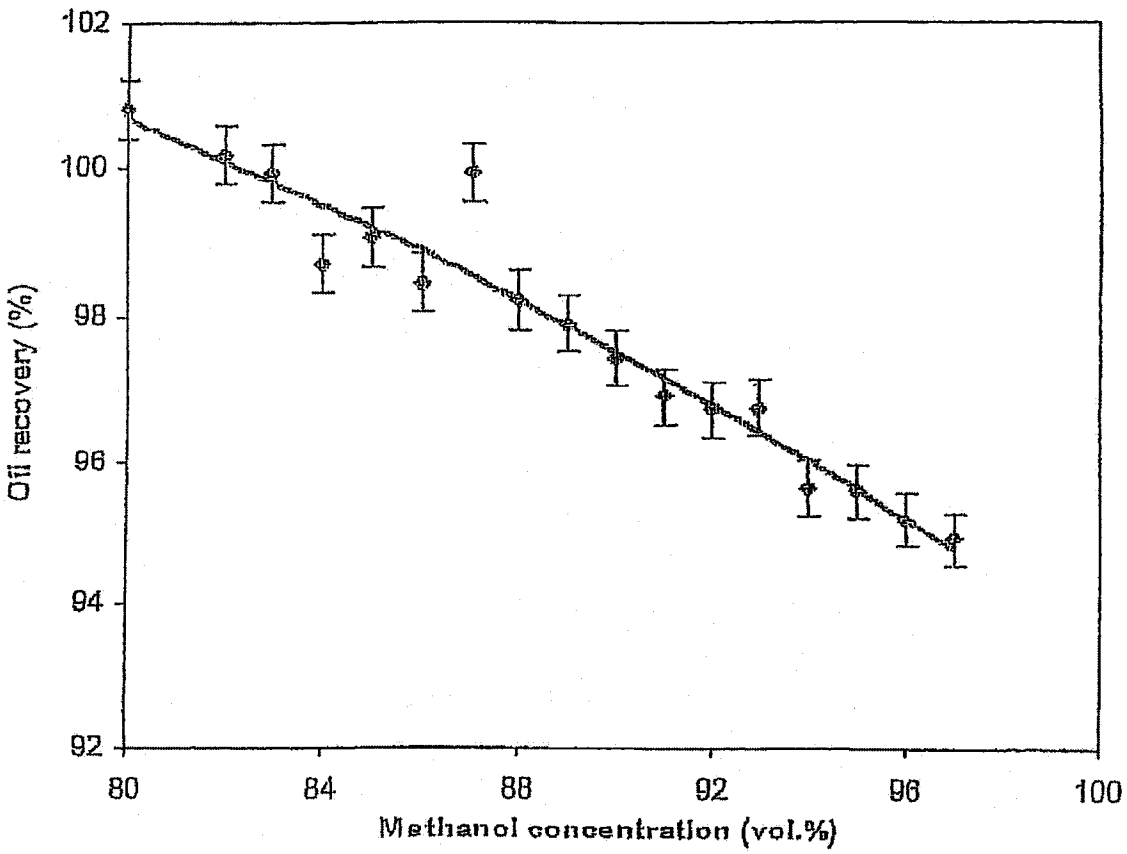
FIG. 11 illustrates results for dilbit recovery from shaker tests at about 50° C. vs. concentration of the active agent (methanol) vol. %.

FIG. 10 and FIG. 11 show the recovery of dilbit versus volume % of methanol in the mixture. Both figures show that dilbit recovery increased as volume % of water in the active agent mixture increased. At higher levels of water content, a point was reached where dilbit recovery exceeded 100% and this was interpreted as carryover of the active agent with the oil as a rag layer or emulsion. At about 25° C., approximately 100% dilbit recovery was achieved at about 90 vol. % methanol, whereas at about 50° C. this was achieved at about 83 vol % methanol. Since dielectric constants tend to decrease with increasing temperature, in this example a higher volume % of water may be required to modulate the degree of solubility of the active agent in the hydrocarbon at higher temperatures relative to the solubility of water in the hydrocarbon, which may allow modulation of the extent of extraction of hydrocarbon fractions into the active agent phase at higher temperatures.

Figure 12:
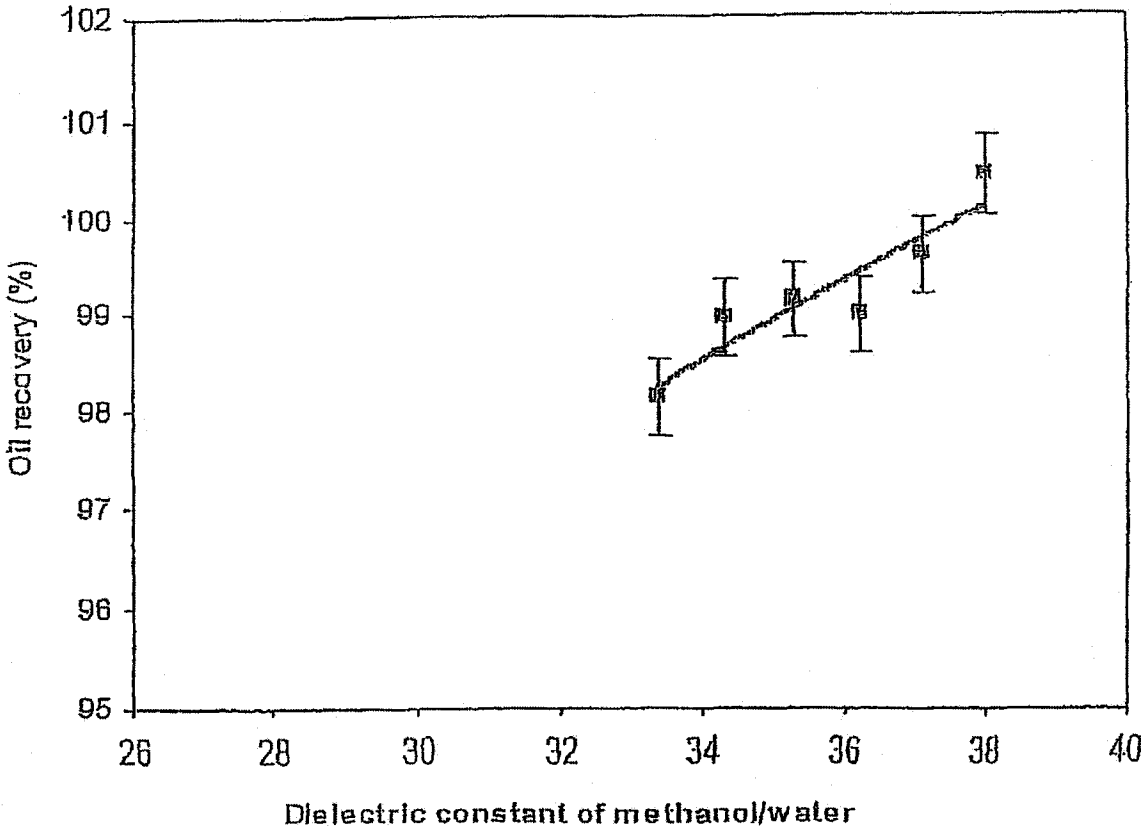
FIG. 12 illustrates results for dilbit recovery from shaker tests at about 25° C. vs. dielectric constant of the active agent (methanol/water)
Figure 13:
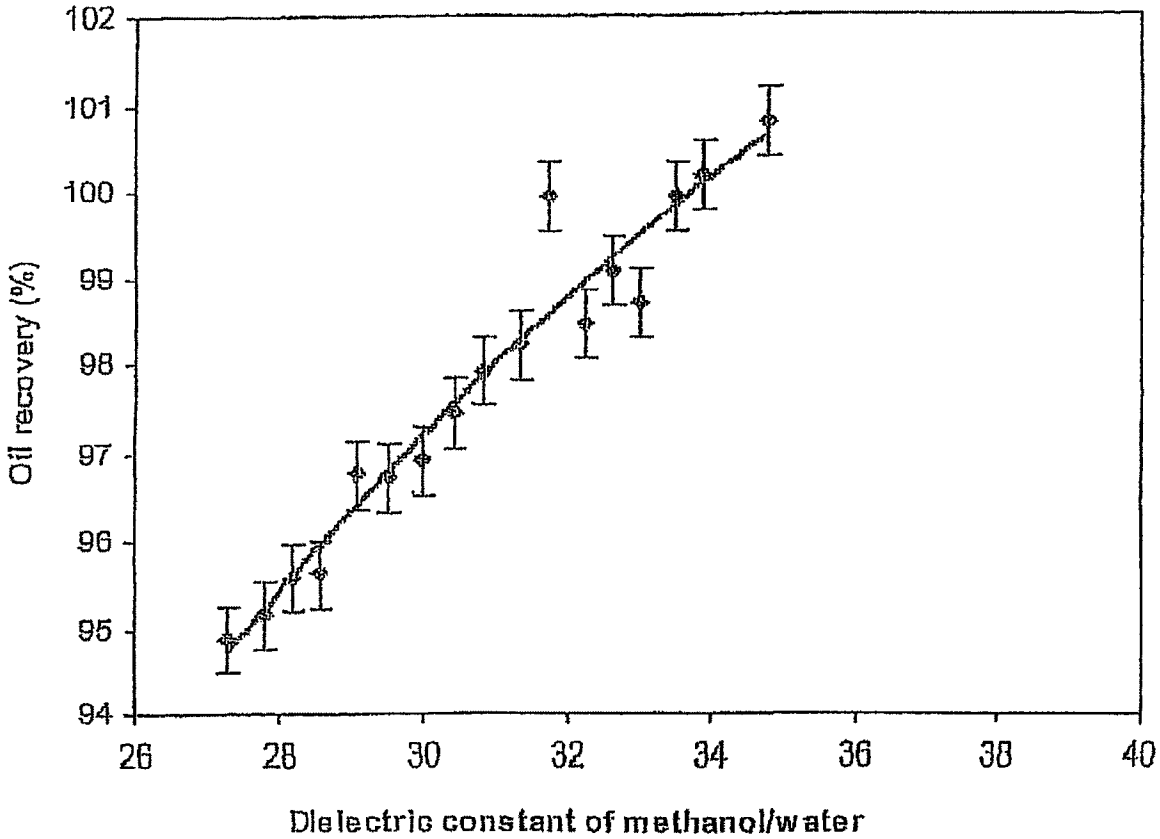
FIG. 13 illustrates results for dilbit recovery from shaker tests at about 50° C. vs. dielectric constant of the active agent (methanol/water)

The impact of dielectric constant on dilbit recoveries at about 25 and about 50° C. is shown in FIG. 12 and FIG. 13 respectively. The dielectric constants of methanol and water are taken as 26.0 and 70.0, respectively at 50° C. The dielectric constants of methanol/water to achieve about 100% recovery of oil at about 25° C. and about 50° C. are approximately 37 and 33 respectively.

The active agents identified as suitable for this type of feed and under the conditions studied have relatively short carbon backbones and one or more alcohol (—OH) functional groups. The active agents identified include methanol, ethanol, ethylene glycol and glycerol as well as mixtures thereof, and mixtures with various concentrations of water. These active agents have the ability to hydrogen bond with themselves and with water. Therefore, they have relatively high boiling points except methanol which has a dower boiling point than water. Depending on the embodiment, some active agents which have tendencies toward formation of azeotropes may affect purification and recycling, which may be a consideration in choosing a suitable active agent. It was found that by manipulating the dielectric constant of the active agent, for example increasing the dielectric constant of methanol by the addition of about 5 to about 20 vol. % of water, the solubility of dilbit in methanol was reduced. For example, for methanol-water as the active agent at about 50° C., the optimal dielectric constant was about 33 (assuming values of about 26 and about 70 for methanol and water respectively at about 50° C.) and corresponded to a composition of about 82.3 vol. % methanol. Thus, performance of a particular active agent for desalting, dewatering, emulsion breaking or a combination thereof may be modulated by the addition of a selected amount of one or more co-active agents with particular dielectric constants or water to tailor the chemical properties of the active agent to the chemical characteristics of the hydrocarbon feed and to achieve a desired level of desalting, dewatering, emulsion breaking or a combination thereof.

Example 7

Solubility of Inorganic Salts in Potential Active Agents

One of the considerations for successful desalting is that the salts (e.g., chloride salts) have good solubility in the active agents. The solubility limit in the active agent will determine the lowest ratio of active agent to the hydrocarbon feed that may be used to achieve the required level of desalting under the particular operating conditions and for a particular set of chemical and physical properties of the hydrocarbon feed to be processed.

High solubility of the salt in the active agent may require a lower ratio of the active agent relative to the hydrocarbon feed, and therefore a more compact apparatus and auxiliary purification and recirculation units. In particular embodiments, the salts of interest, and particularly chloride salts of interest include those of sodium, magnesium and calcium. Depending on the pH of water in the hydrocarbon feed (e.g. in bitumen), and the water used in the extraction, magnesium and calcium may be present as carbonates rather than chlorides. One must also consider that some hydrocarbon feeds such as bitumen, for example, comprise significant concentrations of naphthenic acids, which may also enhance the hydrolysis of various chloride salts especially NaCl. Some of the active agents of the present invention may be suitable for removing species contributing to the TAN level of the hydrocarbon feed.

The solubility of various salts in methanol and methanol-water mixtures at about 25° C. is shown in Table 10.

TABLE 10

| | Solubility (g Salt/100 g $CH_3OH/H_2O$) | | Solubility (g Cl/100 g $CH_3OH/H_2O$) | |
|---|---|---|---|---|
| Salt | 100 vol. % $CH_3OH$ | 95/5 (v/v) $CH_3OH/H_2O$ | 100 vol. % $CH_3OH$ | 95/5 (v/v) $CH_3OH/H_2O$ |
| NaCl | 1.19 | 1.17 | 0.72 | 0.71 |
| $CaCl_2$ | 31.53 | 42.60 | 20.14 | 27.22 |
| $MgCl_2$ | 8.62 | 14.28 | 6.42 | 10.63 |
| $CaCO_3$ | 0.000657 | 0.001213 | — | — |
| $MgCO_3$ | 0.000035 | 0.000063 | — | — |

Methanol is a suitable active agent for sodium chloride. If significant amounts of magnesium or calcium chlorides are to be removed from the hydrocarbon feed, methanol or methanol-water mixtures may be also be suitable active agents.

Example 8

Impact of Light Hydrocarbon Content

In selected embodiments, one consideration in choosing an active agent suitable for desalting, dewatering, emulsion breaking or a combination thereof, is the impact of light components in the hydrocarbon feed such as naphtha on the process. In selected embodiments, use of a certain active agent may result in an increase of the viscosity of the hydrocarbon feed. In such circumstances, the increase in the viscosity may be mitigated or modulated by adjusting the polarity of the particular active agent. For example, in the embodiments using methanol, the polarity of methanol may be modulated by the addition of various amounts of water, for example in the range of about 5 to 18 vol. %. By the addition of water, the solubility of light hydrocarbon fractions of the hydrocarbon feed such as naphtha in the active agent is reduced, which in turn minimizes changes to the viscosity of the hydrocarbon feed.

Experiments were performed to observe the impact of changes in the naphtha content on emulsion breaking, dewatering and desalting of dilbit with various active agents. The experiments were performed at about 50° C. with pure methanol and methanol comprising about 5 vol. % water as active agents, and two ratios of active agent to dilbit. The hydrocarbon feeds tested were dilibit samples (as received) and those diluted with about 25% Suncor naphtha. The results obtained are shown in Table 11.

TABLE 11

| Run # | Active Agent/ Dilbit Ratio | Active Agent (vol. % MeOH) | Naphtha (wt. %) | Chloride (ug/g) Dilbit Initial | Dilbit Final | [MeOH] Final | ΔP for Dilbit (kPa) (1) | Chloride Removal (%) (2) |
|---|---|---|---|---|---|---|---|---|
| N5 | 1:1 | 100% | 0 | 13.7 | 3.80 | 12.6 | 98.6 | 72.3 |
| N7 | 2:1 | 100% | 0 | 12.0 | 2.86 | 7.14 | 177.0 | 76.2 |
| N6 | 2:1 | 100% | 25 | 8.95 | 2.63 | 6.63 | 33.6 | 70.6 |
| N9 | 1:1 | 95% | 0 | 11.5 | 3.50 | 13.3 | 70.8 | 69.6 |
| N10 | 1:1 | 95% | 25 | 8.50 | 1.89 | 10.5 | 8.6 | 77.8 |

Figure 14:
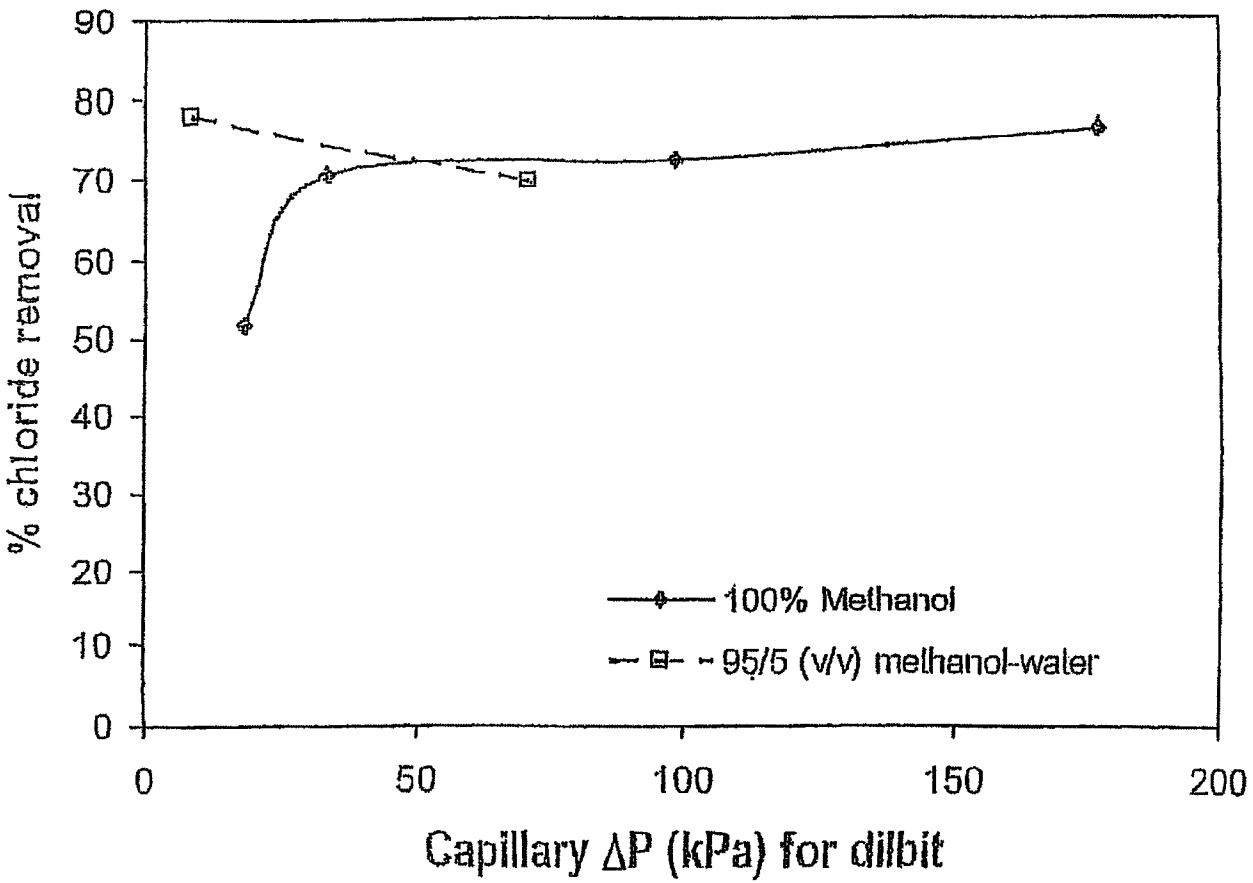
FIG. 14 illustrates a relationship between chloride removal by two active agents (methanol and methanol/water) and dilbit viscosity represented by capillary ΔP.

Notes:
(1) Across capillary during dilbit product collection
(2) Uncorrected for naphtha loss to active agent As is shown in Table 11, the higher active agent/dilbit ratios gave, on average, slightly higher levels of chloride removal. These results also show that for the "as received" dilbit and dilbit diluted with about 25 wt. % naphtha, doubling the active agent/dilbit ratio caused a doubling of the viscosity (reflected in a doubling of pressure drop across a capillary tube during flow of the treated dilbit) of the treated dilbit, which may be due to some extraction of naphtha by the active agent. As a result, chloride removal appears to be somewhat constant with dilbit viscosity as is shown in FIG. 14.

Tests were also conducted with methanol comprising about 5 vol. % water. The use of this more polar active agent mixture resulted in removal of lower amounts of naphtha from dilbit compared to the results obtained with pure methanol under similar conditions. The viscosity of the treated dilbit is much lower as is shown in Table 11. Despite the lower dilbit viscosity, the level of chloride removal was not significantly different from that obtained with pure methanol except for the case with dilbit diluted with 25 wt. % naphtha. These tests indicate that about 94% methanol may be effective in limiting extraction of naphtha under the conditions studied and thus limiting the loss of hydrocarbon in the used active agent phase following separation. Other embodiments employing other active agents under different conditions may require different amounts of one or more co-active agents to effectively mitigate the extraction of naphtha or lighter hydrocarbon fractions in the hydrocarbon feed while allowing for effective removal of chloride under the particular process conditions.

The impact of the active agent or a mixture of active agents on viscosity may be an important consideration in selected embodiments because it affects liquid-liquid mixing, desalting, dewatering, emulsion breaking or a combination thereof. In addition to modulating viscosity by using the active agent or a combination of active agents with or without water, processing parameters may be adjusted to decrease the viscosity (e.g., the temperature).

Although specific embodiments of the invention have been described and illustrated, such embodiments should not to be construed in a limiting sense. Various modifications of form, arrangement of components, steps, details and order of operations of the embodiments illustrated, as well as other embodiments of the invention, will be apparent to persons skilled in the art upon reference to this description. It is therefore contemplated that the appended claims will cover such modifications and embodiments as fall within the true scope of the invention. In the specification including the claims, numeric ranges are inclusive of the numbers defining the range. Citation of references herein shall not be construed as an admission that such references are prior art to the present invention.

What is claimed is:

1. A method of processing an oil sands-derived hydrocarbon feed having a salt concentration greater than 10 parts per million, the oil sands-derived hydrocarbon feed having a hydrocarbon component and an aqueous component emulsified in the hydrocarbon component, wherein the oil sands-derived hydrocarbon feed demulsifies into a hydrocarbon phase and an aqueous phase over an initial demulsification time period, the method comprising:

a. contacting the oil sands-derived hydrocarbon feed with an active agent, wherein the active agent comprises an alcohol, to form a treated feed, wherein:
   i. the active agent has an active agent solubility in the hydrocarbon component,
   ii. the aqueous component has an aqueous component solubility in the hydrocarbon component,
   iii. the active agent solubility in the hydrocarbon component is greater than the aqueous component solubility in the hydrocarbon component,
   iv. the active agent has an active agent solubility in the aqueous component,
   v. the active agent solubility in the aqueous component is greater than the active agent solubility in the hydrocarbon component,
   vi. the active agent solubility in the aqueous component is greater than the aqueous component solubility in the hydrocarbon component, and,
   vii. the active agent dissolves in the aqueous component to decrease the dielectric constant of the aqueous component; and b. allowing a treated demulsified hydrocarbon phase to separate from the active agent and the aqueous component in the treated feed in a modified demulsification time period, wherein the modified demulsification time period is shorter than the initial demulsification time period, wherein the treated demulsified hydrocarbon phase comprise 0 to about 10 parts per million salt, and wherein the hydrocarbon component of the hydrocarbon feed has an API value of about 22.3° or less.

2. The method of claim 1, wherein the treated demulsified hydrocarbon phase comprises 0 to about 5 parts per million salt.

3. The method of claim 1, wherein the active agent solubility in the hydrocarbon component is represented by an active agent dielectric property ranging between a dielectric constant of water and a dielectric constant of the hydrocarbon component.

4. The method of claim 1, wherein the active agent solubility in the hydrocarbon component during contacting is greater than the active agent solubility in the hydrocarbon component during separating.

5. The method of claim 1, further comprising modulating process conditions so that the active agent solubility in the hydrocarbon component during contacting is greater than the active agent solubility in the hydrocarbon component during separating.

6. The method of claim 5, wherein the modulation of the process conditions comprises modulation of temperature, pressure or a combination thereof.

7. The method of claim 1, wherein the active agent solubility in the hydrocarbon component ranges from about 0.01 to about 1 wt. %, or about 1 to about 10 wt. %, or about 10 to about 50 wt. %.

8. The method of claim 1, wherein the aqueous component solubility in the hydrocarbon component ranges from about 0 to about 0.1 wt. %.

9. The method of claim 1, wherein the active agent solubility in the aqueous component ranges from about 0.01 to about 1 wt. %, or about 1 to about 10 wt. %, or about 10 to about 50 wt. %, or about 50 to about 99.9 wt. %.

10. The method of claim 1, wherein the decrease in the dielectric constant of the aqueous component ranges from about 1% to about 10%, or about 10% to about 20%, or about 20% to about 30%, or about 30% to about 40%, or about 40% to about 50%, or about 50% to about 70%.

11. The method of claim 1, wherein the alcohol is selected from alcohols having 1 to 6 carbon atoms.

12. The method of claim 1, wherein the alcohol comprises methanol, ethanol, glycerol, ethylene glycol or a combination thereof.

13. The method of claim 1, wherein the active agent further comprises water.

14. The method of claim 13, wherein a volume ratio of the active agent to water ranges from about 10000:1 to about 1000:1, or about 1000:1 to about 1:20, or about 99:1 to about 20:1, or about 20:1 to about 1:20, or any ratio between about 10000:1 and about 1:20.

15. The method of claim 1, wherein the oil sands-derived hydrocarbon feed further has an initial interfacial tension property with the aqueous component and the treated feed further has a modified interfacial tension property with the aqueous component, the modified interfacial tension property being lower than the initial interfacial tension property.

16. The method of claim 1, wherein the treated demulsified hydrocarbon phase comprises about 0 to about 0.5 wt. % water.

17. The method of claim 1 further comprising modulating the properties of the active agent prior to the contacting step.

18. The method of claim 17, wherein modulating the properties of the active agent comprises modulating a composition of the active agent.

19. The method of claim 18, wherein modulating the composition of the active agent comprises adjusting a dielectric property of the active agent.

20. The method of claim 1 further comprising recovering the active agent from the treated feed.

21. The method of claim 20 further comprising recycling the recovered active agent for contacting with the oil sands-derived hydrocarbon feed.

22. A method of processing an oil sands-derived hydrocarbon feed, the oil sands-derived hydrocarbon feed having a hydrocarbon component and an aqueous component emulsified in the hydrocarbon component, wherein the oil sands-derived hydrocarbon feed demulsifies into a hydrocarbon phase and an aqueous phase over an initial demulsification time period, the method comprising:

a. contacting the oil sands-derived hydrocarbon feed with a first active agent, wherein the first active agent comprises a first alcohol, to modulate a dielectric property of the aqueous component emulsified in the oil sands-derived hydrocarbon feed to form a first modified aqueous component;

b. contacting the oil sands-derived hydrocarbon feed comprising the first modified aqueous component with a second active agent, wherein the second active agent comprises a second alcohol, to modulate a dielectric property of the first modified aqueous component to form a second modified aqueous component and a treated demulsified hydrocarbon phase, wherein the first active agent is more polar than the second active agent, and wherein i. the first active agent has a first active agent solubility in the hydrocarbon component, and the second active agent has a second active agent solubility in the hydrocarbon component, ii. the aqueous component, the first modified aqueous component, and the second modified aqueous component each has an aqueous component solubility, a first modified aqueous component solubility, and a second modified aqueous component solubility, respectively, in the hydrocarbon component, iii. the first active agent solubility, and the second active agent solubility, respectively, in the hydrocarbon component is greater than the aqueous component solubility, the first modified aqueous component solubility, and the second modified aqueous component solubility, respectively, in the hydrocarbon component, iv. the first active agent has a first active agent solubility in the aqueous component, and the second active agent has a second active agent solubility in the first modified aqueous component, v. the first active agent solubility in the aqueous component is greater than the first active agent solubility in the hydrocarbon component, vi. the second active agent solubility in the first modified aqueous component is greater than the second active agent solubility in the hydrocarbon component, vii. the first active agent solubility in the aqueous component is greater than the aqueous component solubility in the hydrocarbon component, and, viii. the second active agent solubility in the first modified aqueous component is greater than the first modified aqueous component solubility in the hydrocarbon component; and c. allowing the treated demulsified hydrocarbon phase to separate from the first and second active agents and from the second modified aqueous component in a modified demulsification time period, wherein the modified demulsification time period is shorter than the initial demulsification time period, wherein the treated demulsified hydrocarbon phase comprises 0 to about 0.5 wt. % aqueous component, and wherein the hydrocarbon component of the hydrocarbon feed has the API value of about 22.3° or less.

23. The method of claim 22 wherein the oil sands-derived hydrocarbon feed has a salt concentration greater than 10 parts per million.

24. The method of claim 22 wherein the treated demulsified hydrocarbon phase comprises about 0 to about 10 parts per million salt wherein hydrocarbon components of the hydrocarbon feed has an API value of about 22.3° or less.

25. The method of claim 22 wherein the first active agent and the second active agent are provided as a single composition.

26. The method of claim 22 wherein each of the first alcohol and the second alcohol are selected from alcohols having 1 to 6 carbon atoms.

27. The method of claim 22 wherein the first alcohol or the second alcohol is methanol.

28. The method of claim 22 wherein the first active agent solubility and the second active agent solubility in the hydrocarbon component are represented by a first active agent dielectric property and a second active agent dielectric property, respectively, and wherein each of the first active agent dielectric property and the second active agent dielectric property is between a dielectric constant of water and a dielectric constant of the hydrocarbon component.

29. The method of claim 22, wherein the first active agent solubility in the hydrocarbon component during contacting is greater than the first active agent solubility in the hydrocarbon component during separating, and the second active agent solubility in the hydrocarbon component during contacting is greater than the second active agent solubility in the hydrocarbon component during separating.

30. The method of claim 22, further comprising modulating process conditions so that the first active agent solubility in the hydrocarbon component during contacting and the second active agent solubility in the hydrocarbon component during contacting are each greater than one or both of the first active agent solubility in the hydrocarbon component during separating and the second active agent solubility in the hydrocarbon component during separating.

31. The method of claim 30, wherein the modulation of the process conditions comprises modulation of temperature, pressure or a combination thereof.

32. The method of claim 22, wherein each of the first alcohol and the second alcohol is selected from an alcohol having 1 to 6 carbon atoms.

33. The method of claim 22, wherein the first alcohol or the second alcohol comprises methanol, ethanol, glycerol, ethylene glycol or a combination thereof.

34. The method of claim 22, wherein the first active agent, the second active agent or both is provided as a composition comprising water.

35. The method of claim 34, wherein a volume ratio of each the first active agent or the second active agent to water ranges from about 10000:1 to about 1000:1, or about 1000:1 to about 1:20, or about 99:1 to about 20:1, or about 20:1 to about 1:20, or any ratio between about 10000:1 and about 1:20.

36. A method of processing an oil sands-derived hydrocarbon feed having a salt concentration greater than 10 parts per million, the oil sands-derived hydrocarbon feed having a hydrocarbon component and an aqueous component emulsified in the hydrocarbon component, wherein the oil sands-derived hydrocarbon feed demulsifies into a hydrocarbon phase and an aqueous phase over an initial demulsification time period, the method comprising:

a. contacting the oil sands-derived hydrocarbon feed with an active agent, wherein the active agent comprises an alcohol, to form a treated feed, wherein:
   i. the active agent has an active agent solubility in the hydrocarbon component,
   ii. the aqueous component has an aqueous component solubility in the hydrocarbon component,
   iii. the active agent solubility in the hydrocarbon component is greater than the aqueous component solubility in the hydrocarbon component,
   iv. the active agent has an active agent solubility in the aqueous component,
   v. the active agent solubility in the aqueous component is greater than the active agent solubility in the hydrocarbon component,
   vi. the active agent solubility in the aqueous component is greater than the aqueous component solubility in the hydrocarbon component, and,
   vii. the active agent dissolves in the aqueous component to decrease the dielectric constant of the aqueous component; and
b. allowing a treated demulsified hydrocarbon phase to separate from the active agent and the aqueous component in the treated feed in a modified demulsification time period, wherein the modified demulsification time period is shorter than the initial demulsification time period, and wherein the hydrocarbon component of the hydrocarbon feed has an API value of about 22.3° or less.

37. The method of claim 36, wherein the active agent solubility in the hydrocarbon component is represented by an active agent dielectric property ranging between a dielectric constant of water and a dielectric constant of the hydrocarbon component.

38. The method of claim 36, wherein the active agent solubility in the hydrocarbon component during contacting is a greater than the active agent solubility in the hydrocarbon component during separating.

39. The method of claim 36, further comprising modulating process conditions so that the active agent solubility in the hydrocarbon component during contacting is greater than the active agent solubility in the hydrocarbon component during separating.

40. The method of claim 39, wherein the modulation of the process conditions comprises modulation of temperature, pressure or a combination thereof.

41. The method of claim 36, wherein the active agent solubility in the hydrocarbon component ranges from about 0.01 to about 1 wt. %, or about 1 to about 10 wt. %, or about 10 to about 50 wt. %.

42. The method of claim 36, wherein the aqueous component solubility in the hydrocarbon component ranges from about 0 to about 0.1 wt. %.

43. The method of claim 36, wherein the active agent solubility in the aqueous component ranges from about 0.01 to about 1 wt. %, or about 1 to about 10 wt. %, or about 10 to about 50 wt. %, or about 50 to about 99.9 wt. %.

44. The method of claim 36, wherein the decrease in the dielectric constant of the aqueous component ranges from about 1% to about 10%, or about 10% to about 20%, or about 20% to about 30%, or about 30% to about 40%, or about 40% to about 50%, or about 50% to about 70%.

45. The method of claim 36, wherein the alcohol is selected from alcohols having 1 to 6 carbon atoms.

46. The method of claim 45, wherein the alcohol having 1 to 6 carbon atoms comprises a linear carbon chain.

47. The method of claim 36, wherein the alcohol comprises methanol, ethanol, glycerol, ethylene glycol or a combination thereof.

48. The method of claim 36, wherein the active agent further comprises water.

49. The method of claim 48, wherein a volume ratio of the active agent to water ranges from about 10000:1 to about 1000:1, or about 1000:1 to about 1:20, or about 99:1 to about 20:1, or about 20:1 to about 1:20, or any ratio between about 10000:1 and about 1:20.

50. The method of claim 36, wherein the oil sands-derived hydrocarbon feed has an initial interfacial tension property with the aqueous component and the treated feed has a modified interfacial tension property with the aqueous component, the modified interfacial tension property being lower than the initial interfacial tension property.

51. The method of claim 36, wherein the treated demulsified hydrocarbon phase comprises about 0 to about 0.5 wt. % water.

52. The method of claim 36 further comprising modulating the properties of the active agent prior to the contacting step.

53. The method of claim 52, wherein modulating the properties of the active agent comprises modulating a composition of the active agent.

54. The method of claim 53, wherein modulating the composition of the active agent comprises adjusting a dielectric property of the active agent.

55. The method of claim 36 further comprising recovering the active agent from the treated feed.

56. The method of claim 55 further comprising recycling the recovered active agent for contacting with the oil sands-derived hydrocarbon feed.

57. The method of claim 56, wherein recycling comprises modulating a composition of the recovered active agent to achieve a desired active agent solubility in the hydrocarbon component of the oil sands-derived hydrocarbon feed.

58. The method of claim 57, wherein modulating the composition of the recovered active agent comprises adjusting a dielectric property of the recovered active agent.

59. A method of processing an oil sands-derived hydrocarbon feed, the oil sands-derived hydrocarbon feed having a hydrocarbon component and an aqueous component emulsified in the hydrocarbon component, wherein the oil sands-derived hydrocarbon feed demulsifies into a hydrocarbon phase and an aqueous phase over an initial demulsification time period, the method comprising:

a. contacting the oil sands-derived hydrocarbon feed with an active agent, wherein the active agent comprises an alcohol, to form a treated feed, wherein:
   i. the active agent has an active agent solubility in the hydrocarbon component,
   ii. the aqueous component has an aqueous component solubility in the hydrocarbon component,
   iii. the active agent solubility in the hydrocarbon component is greater than the aqueous component solubility in the hydrocarbon component,
   iv. the active agent has an active agent solubility in the aqueous component,
   v. the active agent solubility in the aqueous component is greater than the active agent solubility in the hydrocarbon component,
   vi. the active agent solubility in the aqueous component is greater than the aqueous component solubility in the hydrocarbon component, and,
   vii. the active agent dissolves in the aqueous component to decrease the dielectric constant of the aqueous component; and b. allowing a treated demulsified hydrocarbon phase to separate from the active agent and the aqueous component in the treated feed in a modified demulsification time period, wherein the modified demulsification time period is shorter than the initial demulsification time period, wherein the treated demulsified hydrocarbon phase comprises 0 to about 0.5 wt. % aqueous component, and wherein the hydrocarbon component of the hydrocarbon feed has an API value of about 22.3° or less.

60. The method of claim 59, wherein the active agent solubility in the hydrocarbon component is represented by an active agent dielectric property ranging between a dielectric constant of water and a dielectric constant of the hydrocarbon component.

61. The method of claim 59, wherein the active agent solubility in the hydrocarbon component during contacting is a greater than the active agent solubility in the hydrocarbon component during separating.

62. The method of claim 59, further comprising modulating process conditions so that the active agent solubility in the hydrocarbon component during contacting is greater than the active agent solubility in the hydrocarbon component during separating.

63. The method of claim 62, wherein the modulation of the process conditions comprises modulation of temperature, pressure or a combination thereof.

64. The method of claim 59, wherein the active agent solubility in the hydrocarbon component ranges from about 0.01 to about 1 wt. %, or about 1 to about 10 wt. %, or about 10 to about 50 wt. %.

65. The method of claim 59, wherein the aqueous component solubility in the hydrocarbon component ranges from about 0 to about 0.1 wt. %.

66. The method of claim 59, wherein the active agent solubility in the aqueous component ranges from about 0.01 to about 1 wt. %, or about 1 to about 10 wt. %, or about 10 to about 50 wt. %, or about 50 to about 99.9 wt. %.

67. The method of claim 59, wherein the decrease in the dielectric constant of the aqueous component ranges from about 1% to about 10%, or about 10% to about 20%, or about 20% to about 30%, or about 30% to about 40%, or about 40% to about 50%, or about 50% to about 70%.

68. The method of claim 59, wherein the alcohol is selected from alcohols having 1 to 6 carbon atoms.

69. The method of claim 68, wherein the alcohol having 1 to 6 carbon atoms comprises a linear carbon chain.

70. The method of claim 59, wherein the alcohol comprises methanol, ethanol, glycerol, ethylene glycol or a combination thereof.

71. The method of claim 59, wherein the active agent further comprises water.

72. The method of claim 71, wherein a volume ratio of the active agent to water ranges from about 10000:1 to about 1000:1, or about 1000:1 to about 1:20, or about 99:1 to about 20:1, or about 20:1 to about 1:20, or any ratio between about 10000:1 and about 1:20.

73. The method of claim 72, wherein the alcohol is methanol, ethanol or a combination thereof.

74. The method of claim 59, wherein the oil sands-derived hydrocarbon feed further has an initial interfacial tension property with the aqueous component and the treated feed further has a modified interfacial tension property with the aqueous component, the modified interfacial tension property being lower than the initial interfacial tension property.

75. The method of claim 59 further comprising modulating the properties of the active agent prior to the contacting step.

76. The method of claim 75, wherein modulating the properties of the active agent comprises modulating a composition of the active agent.

77. The method of claim 76, wherein modulating the composition of the active agent comprises adjusting a dielectric property of the active agent.

78. The method of claim 59 further comprising recovering the active agent from the treated feed.

79. The method of claim 78 further comprising recycling the recovered active agent for contacting with the oil sands-derived hydrocarbon feed.

80. The method of claim 79, wherein recycling comprises modulating a composition of the recovered active agent to achieve a desired active agent solubility in the hydrocarbon component of the oil sands-derived hydrocarbon feed.

81. The method of claim 80, wherein modulating the composition of the recovered active agent comprises adjusting a dielectric property of the recovered active agent.

82. A method of processing an oil sands-derived hydrocarbon feed, the oil sands-derived hydrocarbon feed having a salt concentration greater than 10 parts per million, the oil sands-derived hydrocarbon feed having a hydrocarbon component and an aqueous component emulsified in the hydrocarbon component, wherein the oil sands-derived hydrocarbon feed demulsifies into a hydrocarbon phase and an aqueous phase over an initial demulsification time period, the method comprising:

a. contacting the oil sands-derived hydrocarbon feed with a first active agent, wherein the first active agent comprising a first alcohol, to modulate a dielectric property of the aqueous component emulsified in the oil sands-derived hydrocarbon feed to form a first modified aqueous component;

b. contacting the oil sands-derived hydrocarbon feed comprising the first modified aqueous component with a second active agent, wherein the second active agent comprising a second alcohol, to modulate a dielectric property of the first modified aqueous component to form a second modified aqueous component and a treated demulsified hydrocarbon phase, wherein the first active agent is more polar than the second active agent, and wherein i. the first active agent has a first active agent solubility in the hydrocarbon component, and the second active agent has a second active agent solubility in the hydrocarbon component, ii. the aqueous component, the first modified aqueous component, and the second modified aqueous component each has an aqueous component solubility, a first modified aqueous component solubility, and a second modified aqueous component solubility, respectively, in the hydrocarbon component, iii. the first active agent solubility, and the second active agent solubility, respectively, in the hydrocarbon component is greater than the aqueous component solubility, the first modified aqueous component solubility, and the second modified aqueous component solubility, respectively, in the hydrocarbon component, iv. the first active agent has a first active agent solubility in the aqueous component, and the second active agent has a second active agent solubility in the first modified aqueous component, v. the first active agent solubility in the aqueous component is greater than the first active agent solubility in the hydrocarbon component, vi. the second active agent solubility in the first modified aqueous component is greater than the second active agent solubility in the hydrocarbon component, vii. the first active agent solubility in the aqueous component is greater than the aqueous component solubility in the hydrocarbon component, and, viii. the second active agent solubility in the first modified aqueous component is greater than the first modified aqueous component solubility in the hydrocarbon component; and c. allowing the treated demulsified hydrocarbon phase to separate from the first and second active agents and from the second modified aqueous component in a modified demulsification time period, wherein the modified demulsification time period is shorter than the initial demulsification time period, and wherein the hydrocarbon component of the hydrocarbon feed has an API value of about 22.3° or less.

83. The method of claim 82 wherein the first active agent and the second active agent are provided as a single composition.

84. The method of claim 82 wherein each of the first alcohol and the are selected from alcohols having 1 to 6 carbon atoms.

85. The method of claim 82 wherein the first alcohol or the second alcohol is methanol.

86. The method of claim 82 wherein the first active agent solubility and the second active agent solubility in the hydrocarbon component are represented by a first active agent dielectric property and a second active agent dielectric property, respectively, and wherein each of the first active agent dielectric property and the second active agent dielectric property is between a dielectric constant of water and a dielectric constant of the hydrocarbon component.

87. The method of claim 82, wherein the first active agent solubility in the hydrocarbon component during contacting is greater than the first active agent solubility hydrocarbon component during separating, and the second active agent solubility in the hydrocarbon component during contacting is greater than the second active agent solubility in the hydrocarbon component during separating.

88. The method of claim 82, further comprising modulating process conditions so that the first active agent solubility in the hydrocarbon component during contacting and the second active agent solubility in the hydrocarbon component during contacting are each greater than one or both of the first active agent solubility in the hydrocarbon component during separating and the second active agent solubility in the hydrocarbon component during separating.

89. The method of claim 88, wherein the modulation of the process conditions comprises modulation of temperature, pressure or a combination thereof.

90. The method of claim 82, wherein each of the first alcohol and the second alcohol is selected from an alcohol having 1 to 6 carbon atoms.

91. The method of claim 82, wherein the first alcohol or the second alcohol comprises methanol, ethanol, glycerol, ethylene glycol or a combination thereof.

92. The method of claim 82, wherein the first active agent, the second active agent or both further comprises water.

93. The method of claim 92, wherein a volume ratio of the first active agent or the second active agent to water ranges from about 10000:1 to about 1000:1, or about 1000:1 to about 1:20, or about 99:1 to about 20:1, or about 20:1 to about 1:20, or any ratio between about 10000:1 and about 1:20.

* * * * *

UNITED STATES PATENT AND TRADEMARK OFFICE

CERTIFICATE OF CORRECTION

PATENT NO. : 9,028,677 B2
APPLICATION NO. : 13/140634
DATED : May 12, 2015
INVENTOR(S) : Richard A. McFarlane and Michael Peter Singleton It is certified that error appears in the above-identified patent and that said Letters Patent is hereby corrected as shown below:

On the Title Page:
Item (76) Inventors, Line 1, change "Richard McFarlane," to --Richard A. McFarlane,--; and Insert the following priority claim information:
--(30) Foreign Application Priority Data
December 19, 2008 (CA) ..... 2,647,964--.

In the Specification:
In column 21, line 61, change "Ditbit" to --Dilbit--.

In the Claims:
In column 26, line 53, Claim 1, change "comprise" to --comprises--;
In column 28, line 56, Claim 22, change "the API value" to --an API value--; and
In column 28, lines 63-64, Claim 24, delete the phrase "wherein hydrocarbon components of the hydrocarbon feed has an API value of about 22.3° or less".

Signed and Sealed this
Sixteenth Day of February, 2016

Michelle K. Lee

Michelle K. Lee
*Director of the United States Patent and Trademark Office*